US011741896B2

(12) United States Patent
Yu

(10) Patent No.: US 11,741,896 B2
(45) Date of Patent: Aug. 29, 2023

(54) PIXEL DRIVING CIRCUIT, DISPLAY APPARATUS, AND PIXEL DRIVING METHOD

(71) Applicants: Chengdu BOE Optoelectronics Technology Co., Ltd., Sichuan (CN); BOE Technology Group Co., Ltd., Beijing (CN)

(72) Inventor: Ziyang Yu, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 164 days.

(21) Appl. No.: 17/419,704

(22) PCT Filed: Sep. 29, 2020

(86) PCT No.: PCT/CN2020/118779
§ 371 (c)(1),
(2) Date: Jun. 29, 2021

(87) PCT Pub. No.: WO2022/067487
PCT Pub. Date: Apr. 7, 2022

(65) Prior Publication Data
US 2022/0319418 A1 Oct. 6, 2022

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01);
(Continued)

(58) Field of Classification Search
None
See application file for complete search history.

(56) References Cited

U.S. PATENT DOCUMENTS

2016/0012780 A1* 1/2016 Lee ..... G09G 3/3291 315/172
2018/0218677 A1 8/2018 Qing et al.
(Continued)

FOREIGN PATENT DOCUMENTS

CN 105139807 A 12/2015
CN 106548753 A 3/2017
(Continued)

OTHER PUBLICATIONS

Beasley et al, "Transistor Level Implementation of CMOS Combinational Logic Circuits", the Technology Interface, Spring 97, pp. 1-14 (Year: 1997).*
(Continued)

*Primary Examiner* — Dorothy Harris
(74) *Attorney, Agent, or Firm* — Intellectual Valley Law, P.C.

(57) ABSTRACT

A pixel driving circuit is provided. The pixel driving circuit includes a data write sub-circuit connected to a data line and connected to a second capacitor electrode, the data write sub-circuit configured to write a voltage of a data voltage signal and a threshold voltage of a driving transistor into the second capacitor electrode in a data write phase; a light emitting control sub-circuit connected to the driving transistor, the light emitting control sub-circuit configured to control a voltage supply signal of a voltage supply line to be written into the driving transistor to generate a driving signal in a light emitting phase; and a first reset transistor having a gate electrode connected to a reset control signal line, a source electrode connected to a first reset signal line, and a drain electrode connected to the gate electrode of the driving transistor and the second capacitor electrode.

11 Claims, 15 Drawing Sheets

(52) U.S. Cl.
CPC ..... *G09G 2300/0819* (2013.01); *G09G 2300/0842* (2013.01); *G09G 2300/0861* (2013.01); *G09G 2310/0251* (2013.01); *G09G 2310/0286* (2013.01); *G09G 2310/08* (2013.01)

(56) References Cited

U.S. PATENT DOCUMENTS

| | | | | |
|---|---|---|---|---|
| 2018/0233085 | A1 | 8/2018 | Wang | |
| 2019/0130832 | A1 | 5/2019 | Chang | |
| 2019/0279574 | A1 | 9/2019 | Kim et al. | |
| 2020/0066212 | A1* | 2/2020 | Kim | G09G 3/3266 |
| 2020/0105192 | A1 | 4/2020 | Nam | |
| 2021/0335249 | A1 | 10/2021 | Zhang et al. | |
| 2022/0020330 | A1* | 1/2022 | Cao | G09G 3/3258 |
| 2022/0327998 | A1* | 10/2022 | Liu | G09G 3/3266 |
| 2022/0383813 | A1* | 12/2022 | Wang | G09G 3/3233 |

FOREIGN PATENT DOCUMENTS

| | | | | | |
|---|---|---|---|---|---|
| CN | 106875890 | A | | 6/2017 | |
| CN | 107908310 | A | | 4/2018 | |
| CN | 109785797 | A | | 5/2019 | |
| CN | 110335564 | A | | 10/2019 | |
| CN | 110675816 | A | | 1/2020 | |
| CN | 110827756 | A | | 2/2020 | |
| CN | 110858471 | A | | 3/2020 | |
| CN | 110969992 | A | | 4/2020 | |
| CN | 111445863 | A | | 7/2020 | |
| CN | 111627976 | A | | 9/2020 | |
| CN | 111710303 | A | | 9/2020 | |
| KR | 20150064543 | A | * | 12/2013 | G09G 3/3208 |
| KR | 20200080787 | A | | 7/2020 | |

OTHER PUBLICATIONS

International Search Report & Written Opinion dated Jun. 30, 2021, regarding PCT/CN2020/118779.

* cited by examiner

PIXEL DRIVING CIRCUIT, DISPLAY APPARATUS, AND PIXEL DRIVING METHOD

CROSS-REFERENCE TO RELATED APPLICATION

This application is a national stage application under 35 U.S.C. § 371 of International Application No. PCT/CN2020/118779, filed Sep. 29, 2020, the contents of which are incorporated by reference in the entirety.

TECHNICAL FIELD

The present invention relates to display technology, more particularly, to a pixel driving circuit, a display apparatus, and a pixel driving method.

BACKGROUND

Organic Light Emitting Diode (OLED) display is one of the hotspots in the field of flat panel display research today. Unlike Thin Transistor-Liquid Crystal Display (TFT-LCD), which uses a stable voltage to control brightness, OLED is driven by a driving current required to be kept constant to control illumination. The OLED display panel includes a plurality of pixel units configured with pixel-driving circuits arranged in multiple rows and columns. Each pixel-driving circuit includes a driving transistor having a gate terminal connected to one gate line per row and a drain terminal connected to one data line per column. When the row in which the pixel unit is gated is turned on, the switching transistor connected to the driving transistor is turned on, and the data voltage is applied from the data line to the driving transistor via the switching transistor, so that the driving transistor outputs a current corresponding to the data voltage to an OLED device. The OLED device is driven to emit light of a corresponding brightness.

SUMMARY

In one aspect, the present disclosure provides a pixel driving circuit, comprising a storage capacitor comprising a first capacitor electrode and a second capacitor electrode, the first capacitor electrode connected to a voltage supply line; a driving transistor configured to generate a driving current for driving a light emitting element to emit light when a voltage of the second capacitor electrode is greater than a threshold voltage of the driving transistor, a gate electrode of the driving transistor is connected to the second capacitor electrode; a data write sub-circuit connected to a data line and connected to the second capacitor electrode, the data write sub-circuit configured to write a voltage of a data voltage signal and a threshold voltage of the driving transistor into the second capacitor electrode in a data write phase; a light emitting control sub-circuit connected to the driving transistor, the light emitting control sub-circuit configured to control a voltage supply signal of the voltage supply line to be written into the driving transistor to generate a driving signal in a light emitting phase; and a first reset transistor having a gate electrode connected to a reset control signal line, a source electrode connected to a first reset signal line, and a drain electrode connected to the gate electrode of the driving transistor and the second capacitor electrode; wherein the first reset transistor configured to be turned on to allow a first initialization voltage signal provided by the first reset signal line to be written into the second capacitor electrode in a reset phase; the first reset transistor configured to be turned off and the first reset signal line is configured to provide a voltage maintaining signal to the source electrode of the first reset transistor in a voltage maintaining phase; and the voltage maintaining signal is different from the first initialization voltage signal.

Optionally, the pixel driving circuit further comprises a second reset transistor having a gate electrode connected to the reset control signal line, a source electrode connected to a second reset signal line, and a drain electrode connected to the light emitting control sub-circuit and an anode of the light emitting element, the second reset transistor configured to write a second initialization voltage signal into the anode of the light emitting element in the reset phase; wherein the first reset signal line and the second reset signal line are independent of each other; and the voltage maintaining signal is different from the second initialization voltage signal.

Optionally, the pixel driving circuit further comprises a dual signal switch sub-circuit connected to the first reset signal line; wherein the dual signal switch sub-circuit is configured to generate the first initialization voltage signal in the reset phase, and generate the voltage maintaining signal in the voltage maintaining phase.

Optionally, the dual signal switch sub-circuit comprises a first control transistor having a gate electrode connected to a first control signal line, a source electrode connected to a first switch signal line configured to provide the voltage maintaining signal, and a drain electrode connected to the first reset signal line; and a second control transistor having a gate electrode connected to a second control signal line, a source electrode connected to a second switch signal line configured to provide the first initialization voltage signal, and a drain electrode connected to the first reset signal line; wherein, in the reset phase and the data write phase, the first control transistor is configured to be turned off, and the second control transistor is configured to be turned on; and in the voltage maintaining phase, the first control transistor is configured to be turned on, and the second control transistor is configured to be turned off.

Optionally, the pixel driving circuit further comprises an inverse switch sub-circuit connected to the dual signal switch sub-circuit; wherein, in the reset phase, the inverse switch sub-circuit is configured to generate a first turning-off control signal through a first control signal line to a gate electrode of a first control transistor to turn off the first control transistor of the dual signal switch sub-circuit, and generate a second turning-on control signal through a second control signal line to a gate electrode of a second control transistor to turn on the second control transistor of the dual signal switch sub-circuit; and in the voltage maintaining phase, the inverse switch sub-circuit is configured to generate a first turning-on control signal through the first control signal line to the gate electrode of the first control transistor to turn on the first control transistor of the dual signal switch sub-circuit, and generate a second turning-off control signal through a second control signal line to a gate electrode of the second control transistor to turn off the second control transistor of the dual signal switch sub-circuit.

Optionally, the inverse switch sub-circuit comprises a third control transistor having a gate electrode connected to the first control signal line, a source electrode connected to a first voltage signal line configured to provide a first voltage signal, and a drain electrode connected to the second control signal line; and a fourth control transistor having a gate electrode connected to a third control signal line, a source electrode connected to a second voltage signal line configured to provide a second voltage signal, and a drain electrode connected to the second control signal line; wherein, in the reset phase and the data write phase, the third control transistor is configured to be turned off, and the fourth control transistor is configured to be turned on; and in the voltage maintaining phase, the third control transistor is configured to be turned on, and the fourth control transistor is configured to be turned off.

Optionally, the data write sub-circuit includes a first transistor and a second transistor; the first reset transistor comprises a gate electrode connected to a reset control signal line, a source electrode connected to a first reset signal line, and a drain electrode connected to a second capacitor electrode of the storage capacitor and a gate electrode of the driving transistor; and the second transistor comprises a gate electrode connected to a gate line, a source electrode connected to the second capacitor electrode of the storage capacitor and the gate electrode of the driving transistor, and a drain electrode connected to a drain electrode of the driving transistor.

Optionally, the light emitting control sub-circuit comprises a third transistor and a fourth transistor; the third transistor comprises a gate electrode connected to a light emitting control signal line, a source electrode connected to the voltage supply line, and a drain electrode connected to the source electrode of the driving transistor and the drain electrode of the first transistor; and the fourth transistor comprises a gate electrode connected to the light emitting control signal line, a source electrode connected to drain electrodes of the driving transistor and the second transistor, and a drain electrode connected to an anode of a light emitting element.

In another aspect, the present disclosure provides an array substrate, comprising a first control gate-on-array circuit comprising a plurality of first cascaded shift registers; a second control gate-on-array circuit comprising a plurality of second cascaded shift registers; and multiple rows of dual signal switch sub-circuit and inverse switch sub-circuit, a respective row comprising a dual signal switch sub-circuit and an inverse switch sub-circuit; wherein the dual signal switch sub-circuit in the respective row is connected to a first reset signal line; and the inverse switch sub-circuit in the respective row is connected to the dual signal switch sub-circuit; the dual signal switch sub-circuit is configured to generate a first initialization voltage signal in a reset phase, and generate a voltage maintaining signal in a voltage maintaining phase; in the reset phase, the inverse switch sub-circuit is configured to generate a first turning-off control signal through a first control signal line to a gate electrode of a first control transistor to turn off the first control transistor of the dual signal switch sub-circuit, and generate a second turning-on control signal through a second control signal line to a gate electrode of a second control transistor to turn on the second control transistor of the dual signal switch sub-circuit; and in the voltage maintaining phase, the inverse switch sub-circuit is configured to generate a first turning-on control signal through the first control signal line to the gate electrode of the first control transistor to turn on the first control transistor of the dual signal switch sub-circuit, and generate a second turning-off control signal through a second control signal line to a gate electrode of the second control transistor to turn off the second control transistor of the dual signal switch sub-circuit.

Optionally, the multiple rows of dual signal switch sub-circuit and inverse switch sub-circuit are respectively connected to multiple first shift registers of the first control gate-on-array circuit, a number of the multiple rows is same as a number of the multiple first shift registers, a respective first shift register in the multiple first shift registers configured to provide the third turning-off control signal and the third turning-on control signal to an inverse switch sub-circuit in a respective row of the multiple rows; and the multiple rows of dual signal switch sub-circuit and inverse switch sub-circuit are commonly connected to a single second shift register of the second control gate-on-array circuit, the single second shift register configured to provide the first turning-on control signal and the first turning-off control signal to inverse switch sub-circuits and dual signal switch sub-circuits in the multiple rows of dual signal switch sub-circuit and inverse switch sub-circuit.

Optionally, the array substrate further comprises a gate scanning gate-on-array circuit comprising a plurality of third cascaded shift registers configured to generate a plurality of gate driving signals; and a light emitting scanning gate-on-array circuit comprising a plurality of fourth cascaded shift registers configured to generate a plurality of light emitting control signals; wherein a respective one of the plurality of first cascaded shift registers and a respective one of the plurality of third cascaded shift registers have a same circuit structure; a respective one of the plurality of second cascaded shift registers and a respective one of the plurality of fourth cascaded shift registers have a same circuit structure; a ratio of dimensions of output transistors respectively in the respective one of the plurality of first cascaded shift registers and the respective one of the plurality of third cascaded shift registers is in a range of 1:3 to 1:2; and a ratio of dimensions of output transistors respectively in the respective one of the plurality of second cascaded shift registers and the respective one of the plurality of fourth cascaded shift registers is in a range of 1:3 to 1:2.

Optionally, the array substrate further comprises multiple rows of pixel driving circuits respectively electrically connected to the multiple rows of dual signal switch sub-circuit and inverse switch sub-circuit; wherein the multiple rows of pixel driving circuits are in a display area of the array substrate; the first control gate-on-array circuit, the second control gate-on-array circuit, the gate scanning gate-on-array circuit, the light emitting scanning gate-on-array circuit, and the multiple rows of dual signal switch sub-circuit and inverse switch sub-circuit are in a peripheral area of the array substrate; the light emitting scanning gate-on-array circuit is on a side of the gate scanning gate-on-array circuit away from the display area; a column of dual signal switch sub-circuits respectively from the multiple rows of dual signal switch sub-circuit and inverse switch sub-circuit is on a side of the light emitting scanning gate-on-array circuit away from the gate scanning gate-on-array circuit; a column of inverse switch sub-circuits respectively from the multiple rows of dual signal switch sub-circuit and inverse switch sub-circuit is on a side of the column of dual signal switch sub-circuits away from the light emitting scanning gate-on-array circuit; the first control gate-on-array circuit is on a side of the column of inverse switch sub-circuits away from the column of dual signal switch sub-circuits; and the second control gate-on-array circuit is on a side of the first control gate-on-array circuit away from the column of inverse switch sub-circuits.

In another aspect, the present disclosure provides a display apparatus, comprising the pixel driving circuit described herein, a first control gate-on-array circuit connected to the third control signal line, and a second control gate-on-array circuit connected to the first control signal line; the display apparatus comprises a plurality of rows of pixel driving circuits; the pixel driving circuit is in a respective row of the plurality of rows of pixel driving circuits; the respective row of the plurality of rows of pixel driving circuits is connected to the dual signal switch sub-circuit and the inverse switch sub-circuit; and the dual signal switch sub-circuit is configured to generate the first initialization voltage signal in the reset phase, and generate the voltage maintaining signal in the voltage maintaining phase, for the respective row of the plurality of rows of pixel driving circuits.

Optionally, the display apparatus further comprises a data driving integrated circuit; wherein the data driving integrated circuit is configured to prior to displaying a respective frame of image of a plurality of frames of images, provide data voltage signals to a plurality of subpixels in the respective frame of image; and assign a calculated value as a value of the voltage maintaining signal; wherein the calculated value is calculated by a function based on the data voltage signals of the plurality of subpixels in the respective frame of image.

Optionally, the function comprises an averaging algorithm; and the calculated value equals to a sum of the threshold voltage of the driving transistor and an average value of the data voltage signals of the plurality of subpixels.

Optionally, the averaging algorithm is selected from a group consisting of root mean square value algorithm, arithmetic mean algorithm, geometric mean algorithm, and weighted mean algorithm.

Optionally, the function is based on a data signal compensation model f(Vdata(1), Vdata(2), . . . , Vdata(N)); and Vdata(1), Vdata(2), . . . , Vdata(N) stand for the data voltage signals of the plurality of subpixels.

In another aspect, the present disclosure provides a pixel driving method, comprising in a reset phase, turning on a first reset transistor to allow a first initialization voltage signal to be written into a second capacitor electrode of a storage capacitor; in a data write phase, turning on a data write sub-circuit to allow a voltage of a data voltage signal and a threshold voltage of a driving transistor to be written into the second capacitor electrode; in a voltage maintaining phase, turning off the first reset transistor and providing a voltage maintaining signal from a first reset signal line to a source electrode of the first reset transistor; and in a light emitting phase, turning on the light emitting control sub-circuit to control a voltage supply signal of a voltage supply line to be written into the driving transistor, and the driving transistor generate a driving current for driving a light emitting element to emit light when a voltage of the second capacitor electrode is greater than a threshold voltage of the driving transistor; wherein the voltage maintaining signal is different from the first initialization voltage signal.

Optionally, the pixel driving method further comprises, in the reset phase, turning on a second reset transistor to allow a second initialization voltage signal into an anode of the light emitting element in the reset phase; wherein the voltage maintaining signal is different from the second initialization voltage signal.

Optionally, the pixel driving method further comprises generating, using a dual signal switch sub-circuit connected to the first reset signal line, the first initialization voltage signal in the reset phase, and the voltage maintaining signal in the voltage maintaining phase.

Optionally, generating the first initialization voltage signal in the reset phase comprises providing a first turning-off control signal through a first control signal line to a gate electrode of a first control transistor to turn off the first control transistor of the dual signal switch sub-circuit; providing the first initialization voltage signal through a second switch signal line to a source electrode of a second control transistor; and providing a second turning-on control signal through a second control signal line to a gate electrode of the second control transistor to turn on the second control transistor of the dual signal switch sub-circuit; thereby allowing the first initialization voltage signal to pass from the source electrode of the second control transistor to a drain electrode of the second control transistor, and in turn to the first reset signal line connected to the drain electrode of the second control transistor.

Optionally, the pixel driving method further comprises, in the reset phase, providing the first turning-off control signal through the first control signal line to a gate electrode of a third control transistor of an inverse switch sub-circuit to turn off the third control transistor of the inverse switch sub-circuit connected to the dual signal switch sub-circuit, and simultaneously to the gate electrode of the first control transistor to turn off the first control transistor; providing a second voltage signal through a second voltage signal line to a source electrode of a fourth control transistor of the inverse switch sub-circuit; and providing a third turning-on control signal through a third control signal line to a gate electrode of the fourth control transistor of the inverse switch sub-circuit to turn on the fourth control transistor of the inverse switch sub-circuit, thereby allowing the second voltage signal to pass from the source electrode of the fourth control transistor to a drain electrode of the fourth control transistor, and in turn to the second control signal line connected to the gate electrode of the second control transistor, the second voltage signal functioning as the second turning-on control signal to turn on the second control transistor in the reset phase.

Optionally, generating the voltage maintaining signal in the voltage maintaining phase comprises providing the voltage maintaining signal through a first switch signal line to a source electrode of a first control transistor; providing a first turning-on control signal through a first control signal line to a gate electrode of the first control transistor to turn on the first control transistor of the dual signal switch sub-circuit, thereby allowing the voltage maintaining signal to pass from the source electrode of the first control transistor to a drain electrode of the first control transistor, and in turn to the first reset signal line connected to the drain electrode of the first control transistor; and providing a second turning-off control signal through a second control signal line to a gate electrode of a second control transistor to turn off the second control transistor of the dual signal switch sub-circuit.

Optionally, the pixel driving method further comprises, in the voltage maintaining phase, providing a first voltage signal through a first voltage signal line to a source electrode of a third control transistor of an inverse switch sub-circuit connected to the dual signal switch sub-circuit; providing the first turning-on control signal through the first control signal line to a gate electrode of the third control transistor to turn on the third control transistor, thereby allowing the first voltage signal to pass from the source electrode of the third control transistor to a drain electrode of the third control transistor, and in turn to the second control signal line connected to the gate electrode of the second control transistor, the first voltage signal functioning as the second turning-off control signal to turn off the second control transistor in in the voltage maintaining phase; and providing a third turning-off control signal through a third control signal line to a gate electrode of a fourth control transistor of the inverse switch sub-circuit to turn off the fourth control transistor.

Optionally, the pixel driving method further comprises generating, using the dual signal switch sub-circuit connected to the first reset signal line, the first initialization voltage signal in the data write phase.

Optionally, the pixel driving method further comprises generating, using the dual signal switch sub-circuit connected to the first reset signal line, the first initialization voltage signal in an initial phase.

Optionally, the pixel driving method further comprises, prior to displaying a respective frame of image of a plurality of frames of images, obtaining data voltage signals of a plurality of subpixels of a display panel in the respective frame of image; and assigning a calculated value as a value of the voltage maintaining signal; wherein the calculated value is calculated by a function based on the data voltage signals of the plurality of subpixels in the respective frame of image.

Optionally, the function comprises an averaging algorithm; and the calculated value equals to a sum of the threshold voltage of the driving transistor and an average value of the data voltage signals of the plurality of subpixels.

Optionally, the averaging algorithm is selected from a group consisting of root mean square value algorithm, arithmetic mean algorithm, geometric mean algorithm, and weighted mean algorithm.

Optionally, the function is based on a data signal compensation model f(Vdata(1), Vdata(2), . . . , Vdata(N)); and Vdata(1), Vdata(2), . . . , Vdata(N) stand for the data voltage signals of the plurality of subpixels.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

The present disclosure provides, inter alia, a pixel driving circuit, a display apparatus, and a pixel driving method that substantially obviate one or more of the problems due to limitations and disadvantages of the related att. In one aspect, the present disclosure provides a pixel driving circuit. In some embodiments, the pixel driving circuit includes a storage capacitor having a first capacitor electrode and a second capacitor electrode, the first capacitor electrode connected to a voltage supply line; a driving transistor configured to generate a driving current for driving a light emitting element to emit light when a voltage of the second capacitor electrode is greater than a threshold voltage of the driving transistor, the gate electrode of the driving transistor is connected to the second capacitor electrode; a data write sub-circuit connected to a data line and connected to the second capacitor electrode, the data write sub-circuit configured to write a voltage of a data voltage signal and a threshold voltage of the driving transistor into the second capacitor electrode in a data write phase; a light emitting control sub-circuit connected to the driving transistor, the light emitting control sub-circuit configured to control a voltage supply signal of the voltage supply line to be written into the driving transistor to generate a driving signal in a light emitting phase; and a first reset transistor having a gate electrode connected to a reset control signal line, a source electrode connected to a first reset signal line, and a drain electrode connected to the gate electrode of the driving transistor and the second capacitor electrode. Optionally, the first reset transistor configured to be turned on to allow a first initialization voltage signal provided by the first reset signal line to be written into the second capacitor electrode in a reset phase. Optionally, the first reset transistor configured to be turned off and the first reset signal line is configured to provide a voltage maintaining signal to the source electrode of the first reset transistor in a voltage maintaining phase. Optionally, the voltage maintaining signal is different from the first initialization voltage signal.

Figure 1:
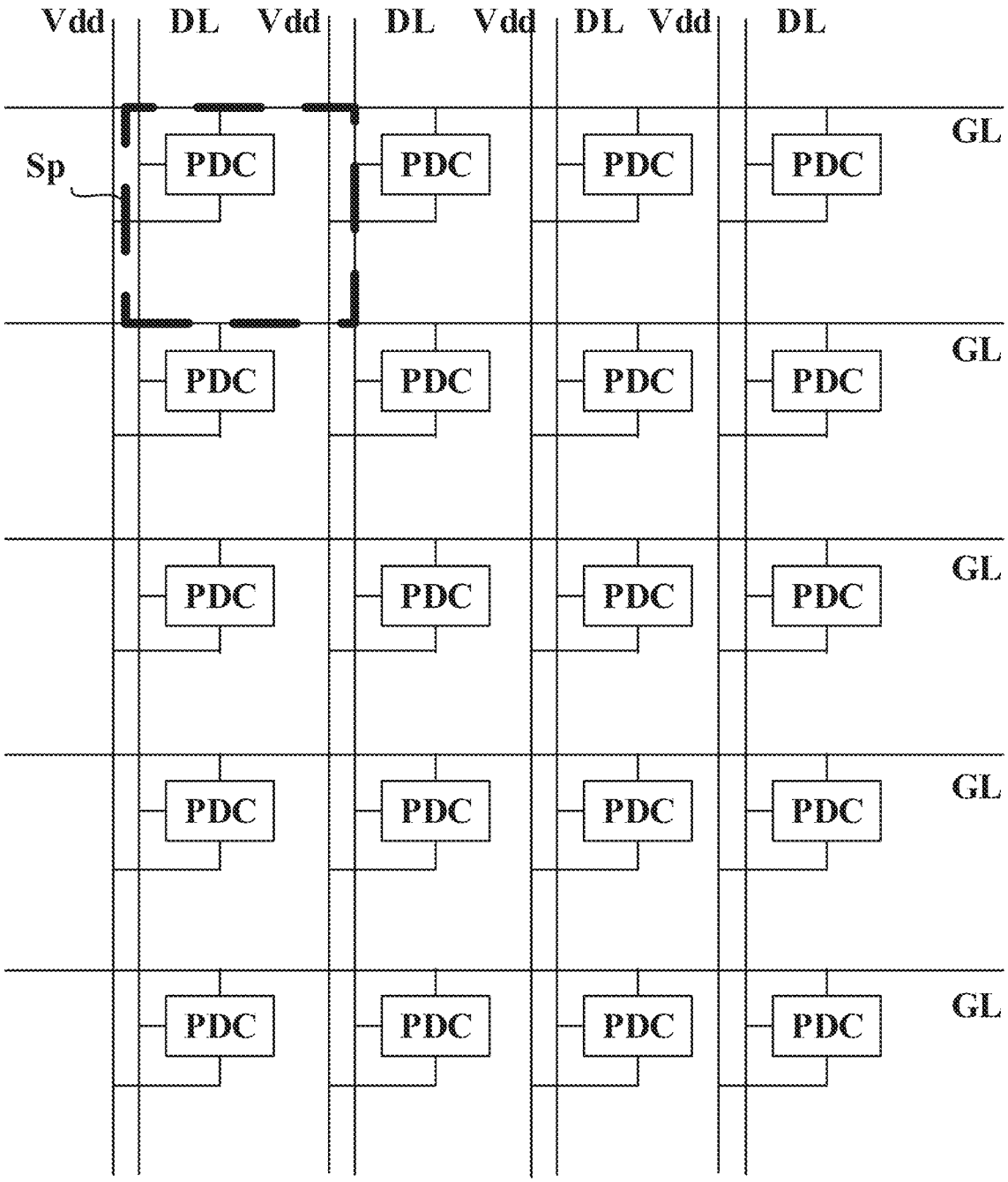
FIG. 1 is a plan view of a display panel having a pixel driving circuit in some embodiments according to the present disclosure.

FIG. 1 is a plan view of an array substrate in some embodiments according to the present disclosure. Referring to FIG. 1, the array substrate includes an array of subpixels Sp. Each subpixel includes an electronic component, e.g., a light emitting element. In one example, the light emitting element is driven by a pixel driving circuit PDC. The array substrate includes a gate GL, a data line DL, a voltage supply line (e.g., a high voltage supply line Vdd), and a second voltage supply line (e.g., a low voltage supply line Vss), each of which electrically connected to the pixel driving circuit PDC. Light emission in a respective one of the subpixels Sp is driven by a pixel driving circuit PDC. In one example, a high voltage signal (e.g., a VDD signal) is input, through the high voltage support line Vdd, to the pixel driving circuit PDC connected to an anode of the light emitting element; a low voltage signal (e.g., a VSS signal) is input, through a low voltage supply line Vss, to a cathode of the light emitting element. A voltage difference between the high voltage signal (e.g., the VDD signal) and the low voltage signal (e.g., the VSS signal) is a driving voltage ΔV that drives light emission in the light emitting element.

Various appropriate pixel driving circuits may be used in the present array substrate. Examples of appropriate driving circuits include 3T1C, 2T1C, 4T1C, 4T2C, 5T2C, 6T1C, 7T1C, 7T2C and 8T2C. In some embodiments, the respective one of the plurality of pixel driving circuits is a 7T1C driving circuit. Various appropriate light emitting elements may be used in the present array substrate. Examples of appropriate light emitting elements include organic light emitting diodes, quantum dots light emitting diodes, and micro light emitting diodes. Optionally, the light emitting element is micro light emitting diode. Optionally, the light emitting element is an organic light emitting diode including an organic light emitting layer.

Figure 2:
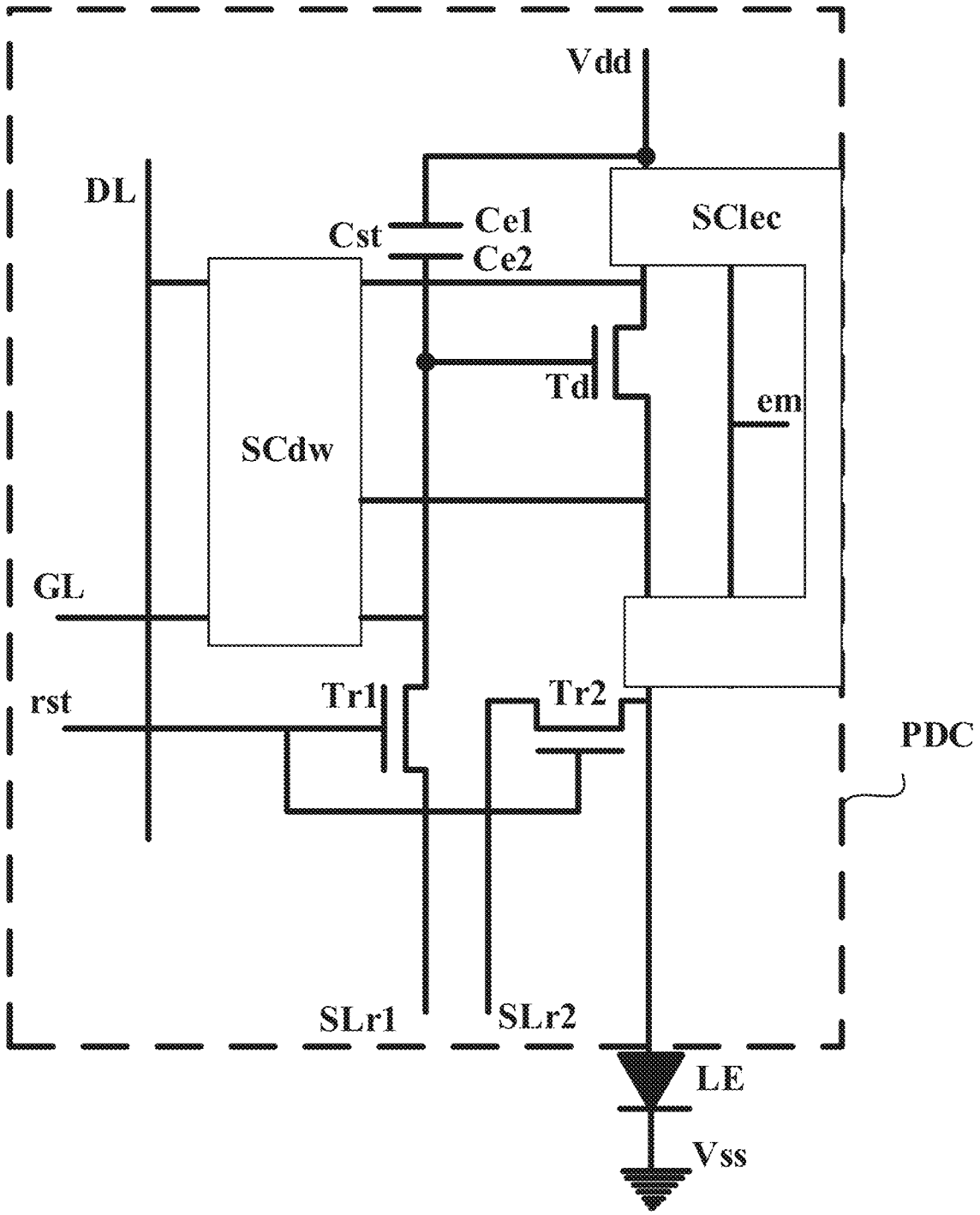
FIG. 2 is a circuit diagram illustrating the structure of a pixel driving circuit in some embodiments according to the present disclosure.

FIG. 2 is a circuit diagram illustrating the structure of a pixel driving circuit in some embodiments according to the present disclosure. Referring to FIG. 2, in some embodiments, the pixel driving circuit PDC includes a storage capacitor Cst having a first capacitor electrode Ce1 and a second capacitor electrode Ce2, the first capacitor electrode Ce1 connected to a voltage supply line Vdd; a driving transistor Td, the gate electrode of the driving transistor Td is connected to the second capacitor electrode Ce2; a data write sub-circuit SCdw connected to a data line DL and connected to the second capacitor electrode Ce2; a light emitting control sub-circuit SClec connected to the driving transistor Td; and a first reset transistor Tr1 having a gate electrode connected to a reset control signal line rst, a source electrode connected to a first reset signal line SLr1, and a drain electrode connected to the gate electrode of the driving transistor Td and the second capacitor electrode Ce2. The driving transistor Td is configured to generate a driving current for driving a light emitting element LE to emit light when a voltage of the second capacitor electrode Ce2 is greater than a threshold voltage of the driving transistor Td. The data write sub-circuit SCdw is configured to write a voltage of a data voltage signal and a threshold voltage of the driving transistor Td into the second capacitor electrode Ce2 in a data write phase. The light emitting control sub-circuit SClec is configured to control a voltage supply signal of the voltage supply line Vdd to be written into the driving transistor Td to generate a driving signal in a light emitting phase.

In some embodiments, the pixel driving circuit PDC further includes a second reset transistor Tr2 having a gate electrode connected to the reset control signal line rst, a source electrode connected to a second reset signal line SLr2, and a drain electrode connected to the light emitting control sub-circuit SClec and an anode of the light emitting element LE. The second reset transistor Tr2 is configured to write a second initialization voltage signal into the anode of the light emitting element LE in the reset phase.

Figure 3:
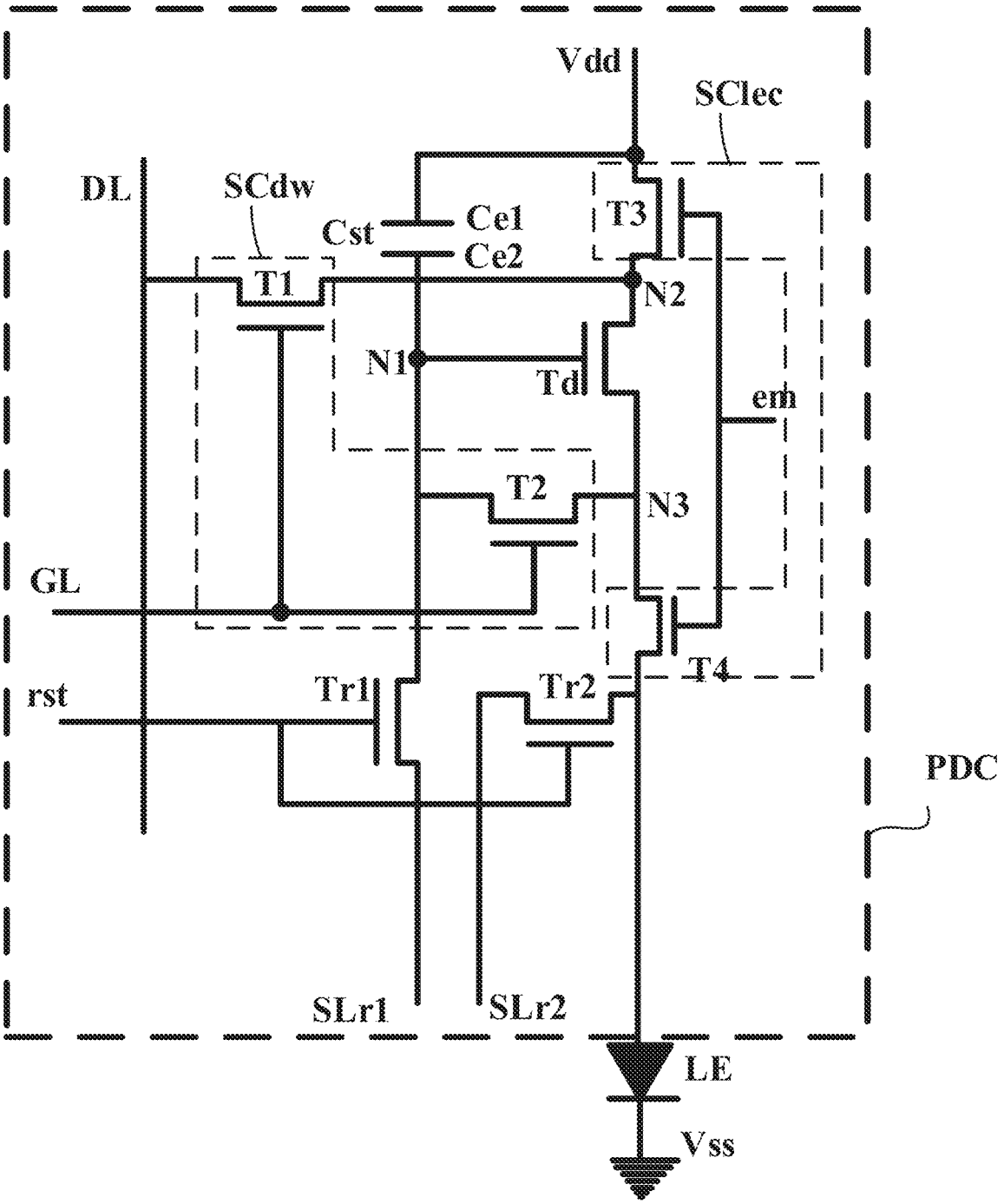
FIG. 3 is a circuit diagram illustrating the structure of a pixel driving circuit in some embodiments according to the present disclosure.

FIG. 3 is a circuit diagram illustrating the structure of a pixel driving circuit in some embodiments according to the present disclosure. Referring to FIG. 2 and FIG. 3, in some embodiments, the data write sub-circuit SCdw includes a first transistor T1 and a second transistor T2; and the light emitting control sub-circuit SClec includes a third transistor T3 and a fourth transistor T4.

Referring to FIG. 3, in some embodiments, the pixel driving circuit PDC includes a driving transistor Td; a storage capacitor Cst having a first capacitor electrode Ce1 and a second capacitor electrode Ce2; a first reset transistor T1 having a gate electrode connected to a reset control signal line rst, a source electrode connected to a first reset signal line SLr1, and a drain electrode connected to a second capacitor electrode Ce2 of the storage capacitor Cst and a gate electrode of the driving transistor Td; a first transistor T1 having a gate electrode connected to a gate line GL, a source electrode connected to the data line DL, and a drain electrode connected to a source electrode of the driving transistor Td; a second transistor T2 having a gate electrode connected to the gate line GL, a source electrode connected to the second capacitor electrode Ce2 of the storage capacitor Cst and the gate electrode of the driving transistor Td, and a drain electrode connected to a drain electrode of the driving transistor Td; a third transistor T3 having a gate electrode connected to a light emitting control signal line em, a source electrode connected to the voltage supply line Vdd, and a drain electrode connected to the source electrode of the driving transistor Td and the drain electrode of the first transistor T1; a fourth transistor T4 having a gate electrode connected to the light emitting control signal line em, a source electrode connected to drain electrodes of the driving transistor Td and the second transistor T2, and a drain electrode connected to an anode of a light emitting element LE; and a second reset transistor Tr2 having a gate electrode connected to a second reset control signal line rst2, a source electrode connected to a second reset signal line Vint2, and a drain electrode connected to the drain electrode of the fourth transistor T4 and the anode of the light emitting element LE. The first capacitor electrode Ce1 is connected to the voltage supply line Vdd and the source electrode of the third transistor T3.

Figure 4:
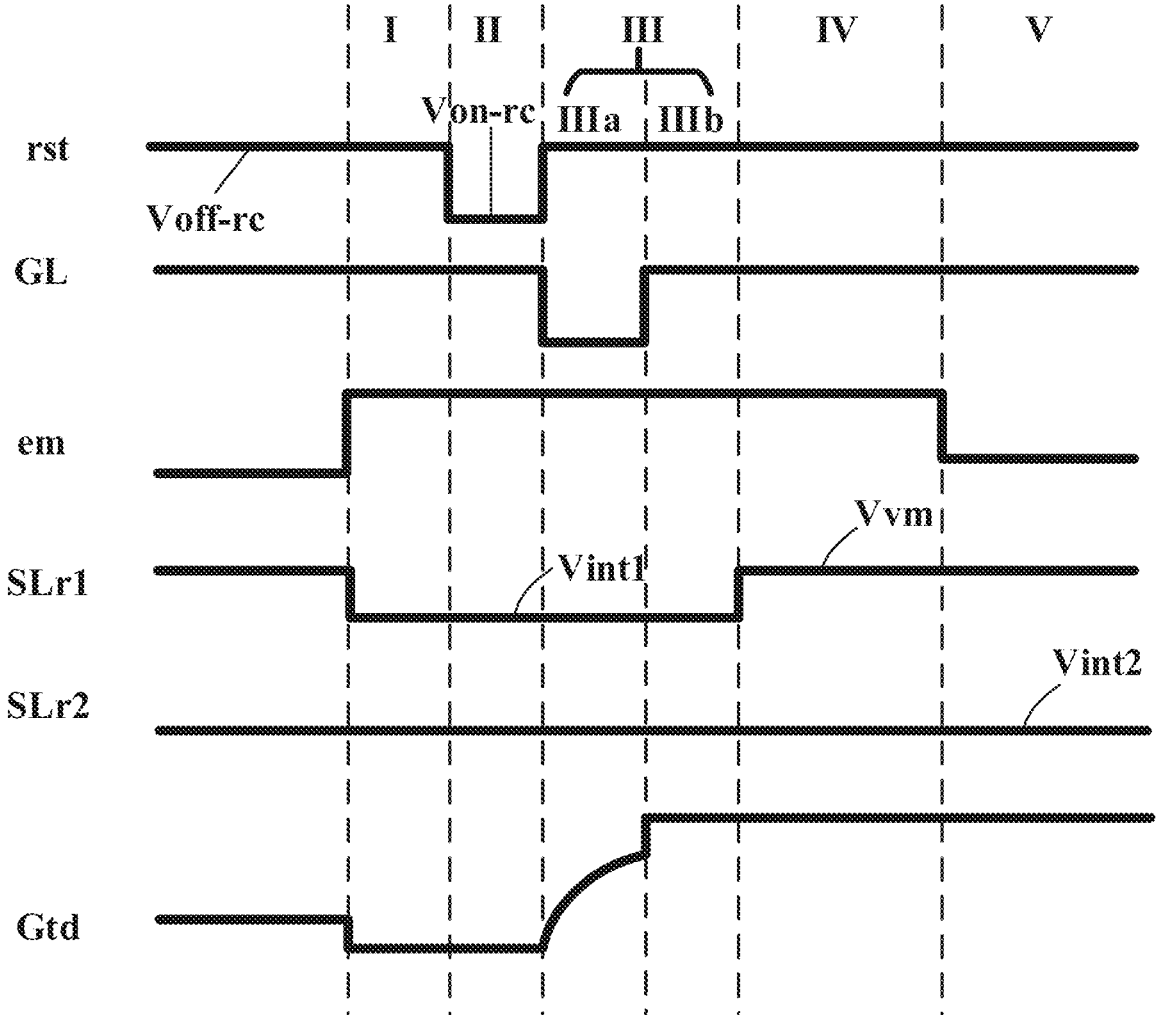
FIG. 4 is a timing diagram of operating a display panel having a pixel driving circuit in some embodiments according to the present disclosure.

FIG. 4 is a timing diagram of operating a display panel having a pixel driving circuit in some embodiments according to the present disclosure. Referring to FIG. 4, in some embodiments, the timing includes five phases: an initial phase I, a reset phase II, a data write phase III, a voltage maintaining phase IV, and a light emitting phase V. The data write phase III in some embodiments includes a first sub-phase IIIa and a second sub-phase IIIb. Extraction of a threshold voltage of the driving transistor is performed in the first sub-phase IIIa.

Referring to FIG. 3 and FIG. 4, In the initial phase I, a turning-off reset control signal Voff-rc is provided through the reset control signal line rst to gate electrodes of the first reset transistor Tr1 and the second reset transistor Tr2 to turn off the first reset transistor Tr1 and the second reset transistor Tr2. In the initial phase I, the gate line GL is provided with a turning-off signal, thus the first transistor T1 and the second transistor T2 in the data write sub-circuit are turned off. The light emitting control signal line em is provided with a high voltage signal to turn off the third transistor T3 and the fourth transistor T4 of the light emitting control sub-circuit.

In the reset phase II, a turning-on reset control signal Von-rc is provided through the reset control signal line rst to the gate electrodes of the first reset transistor Tr1 to turn on the first reset transistor Tr1; allowing the first initialization voltage signal Vint1 to pass from a source electrode of the first reset transistor Tr1 to a drain electrode of the first reset transistor Tr1 and in turn to the second capacitor electrode Ce2 and the gate electrode of the driving transistor Td. The gate electrode of the driving transistor Td is initialized. The turning-on reset control signal Von-rc is also provided through the reset control signal line rst to the gate electrodes of the second reset transistor Tr2 to turn on the second reset transistor Tr2; allowing the second initialization voltage signal Vint2 to pass from a source electrode of the second reset transistor Tr2 to a drain electrode of the second reset transistor Tr2 and in turn to the anode of the light emitting element LE. The anode of the light emitting element LE is initialized, to improve the contrast of the light emitting element LE. The first capacitor electrode Ce1 receives a high voltage signal from the voltage supply line Vdd. The second capacitor electrode Ce2 is charged in the reset phase II due to an increasing voltage difference between the first capacitor electrode Ce1 and the second capacitor electrode Ce2. In the reset phase II, the gate line GL is provided with a turning-off signal, thus the first transistor T1 and the second transistor T2 in the data write sub-circuit are turned off. The light emitting control signal line em is provided with a high voltage signal to turn off the third transistor T3 and the fourth transistor T4 of the light emitting control sub-circuit. A node N1 connecting the gate electrode of the driving transistor Td and the second capacitor electrode Ce2 has a voltage level Gtd equals to that of the first initialization voltage signal Vint1.

In the data write phase III, the turning-off reset control signal Voff-rc is again provided through the reset control signal line rst to the gate electrodes of the first reset transistor Tr1 and the second reset transistor Tr2 to turn off the first reset transistor Tr1 and the second reset transistor Tr2. In the first sub-phase IIIa of the data write phase III, the gate line GL is provided with a turning-on signal, thus the first transistor T1 and the second transistor T2 in the data write sub-circuit are turned on. A gate electrode and a drain electrode of the driving transistor Td are respectively connected with the source electrode and the drain electrode of the second transistor T2. Because the second transistor T2 is turned on in the first sub-phase IIIa of the data write phase III, the gate electrode and the drain electrode of the driving transistor Td are connected and short circuited, and only the PN junction between the gate electrode and a source electrode of the driving transistor Td is effective, thus rendering the driving transistor Td in a diode connecting mode. The first transistor T1 is turned on in the first sub-phase IIIa of the data write phase III. The data voltage signal transmitted through the data line DL is received by a source electrode of the first transistor T1, and in turn transmitted to the source electrode of the driving transistor Td, which is connected to the drain electrode of the first transistor T1. A node N2 connecting to the source electrode of the driving transistor Td has a voltage level of the data voltage signal. Because only the PN junction between the gate electrode and a source electrode of the driving transistor Td is effective, the voltage level Gtd at the node N1 in the first sub-phase IIIa increase gradually to (Vdata+Vth), wherein the Vdata is the voltage level of the data voltage signal, and the Vth is the voltage level of the threshold voltage Th of the PN junction. The storage capacitor Cst is discharged because the voltage difference between the first capacitor electrode Ce1 and the second capacitor electrode Ce2 is reduced to a relatively small value. The light emitting control signal line em is provided with a high voltage signal to turn off the third transistor T3 and the fourth transistor T4 of the light emitting control sub-circuit. In the second sub-phase IIIb, the gate line GL is provided with a turning-off signal, the first transistor T1 and the second transistor T2 in the data write sub-circuit are turned off, and the voltage level Gtd at the node N1 in the second sub-phase III is maintained at (Vdata+Vth).

In the light emitting phase V, the turning-off reset control signal Voff-rc is again provided through the reset control signal line rst to the gate electrodes of the first reset transistor Tr1 and the second reset transistor Tr2 to turn off the first reset transistor Tr1 and the second reset transistor Tr2. The gate line GL is provided with a turning-off signal, the first transistor T1 and the second transistor T2 in the data write sub-circuit are turned off. The light emitting control signal line em is provided with a low voltage signal to turn on the third transistor T3 and the fourth transistor T4 of the light emitting control sub-circuit. The voltage level Gtd at the node N1 in the light emitting phase V is maintained at (Vdata+Vth), the driving transistor Td is turned on by the voltage level Gtd, and working in the saturation area. A path is formed through the third transistor T3, the driving transistor Td, the fourth transistor T4, to the light emitting element LE. The driving transistor Td generates a driving current for driving the light emitting element LE to emit light. A voltage level at a node N3 connected to the drain electrode of the driving transistor Td equals to a light emitting voltage of the light emitting element LE.

Display panels having light emitting diodes are driven by a driving current to emit light. Typically the driving current is generated by controlling a driving voltage of the driving transistor. The driving current may be calculated using the following equation:

$$Id = \frac{1}{2} * \mu * C_{ox} * \frac{W}{L} * (V_{gs} - V_{th})^2 = \frac{k}{2}(Vdata - Vref)^2$$

wherein Id stands for the driving current, Vdata stands for the voltage level of a data voltage signal, Vref stands for a voltage level of a reference voltage line, Vgs stands for the voltage between the gate and the source of the driving transistor Td, μ represents the mobility of the driving transistor Td, Cox (W/L) represents the capacitance of the isolation layer of the gate, W represent the width of the channel of the TFT, and L represents the length of the channel of the TFT.

The storage capacitor Cst is typically used as the component for maintaining the voltage level at the gate electrode of the driving transistor Td. In a high-frequency display (e.g., 60 Hz to 120 Hz), the typical duration required for maintaining the voltage is 8.3 ms to 16.67 ms. However, in a low-frequency display (e.g., 1 Hz or lower), the typical duration required for maintaining the voltage can be as long as 1 second or longer. Thus, voltage maintaining is critical for the low-frequency display.

The inventors of the present disclosure discover that, in the light emitting phase V, if the source electrode of the first reset transistor Tr1 is provided with a low voltage signal, a voltage different between the source electrode of the first reset transistor Tr1 and the drain electrode of the first reset transistor Tr1 may be a relatively large value, leading to leakage from the drain electrode to the source electrode of the first reset transistor Tr1, reducing the voltage level at the node N1. The inventors of the present disclosure discover that this leakage affects the Vgs of the driving transistor Td (voltage difference between the gate electrode and the source electrode of the driving transistor Td), leading to a compromised contrast and flickering in the display panel. As an example to illustrate the issue, if the source electrode of the first reset transistor Tr1 has a voltage level of −3 V, and the drain electrode of the first reset transistor Tr1 has a voltage level of 0 V to 6 V (same as the voltage level of Gtd in the light emitting phase V), the voltage difference between the source electrode of the first reset transistor Tr1 and the drain electrode of the first reset transistor Tr1 is in a range of 3 V to 9 V, resulting in a leakage of the charges at the gate electrode of the driving transistor Td.

The inventors of the present disclosure discover that, unexpectedly and surprisingly, that the leakage issue can be obviated by having the first reset signal line SLr1 and the second reset signal line SLr2 independent of each other in the pixel driving circuit. In some embodiments, the timing of operating the pixel driving circuit further includes a voltage maintaining phase IV between the data write phase III and the light emitting phase V. In the voltage maintaining phase IV, the control signals are maintained at same respective states as those in the second sub-phase IIIb, except that a voltage maintaining signal Vvm is provided to the first reset signal line SLr1. As an example for illustration purpose, the source electrode of the first reset transistor Tr1 has a voltage level of 3 V, and the drain electrode of the first reset transistor Tr1 has a voltage level of 0 V to 6 V (same as the voltage level of Gtd in the light emitting phase V), the voltage difference between the source electrode of the first reset transistor Tr1 and the drain electrode of the first reset transistor Tr1 is now reduced to −3 V to 3 V, significantly preventing the leakage of the charges at the gate electrode of the driving transistor Td, particularly in low-frequency display.

Table 1 shows unexpected and surprising reduction of the voltage leakage in a pixel driving circuit according to the present disclosure ("Present PDC") as compared to a reference pixel driving circuit ("Reference PDC") in which the first reset transistor and the second reset transistor share a same reset signal or a same reset signal line. In one example, the first reset signal line in the reference pixel driving circuit is provided with a constant first initialization voltage (e.g., at a level of −3 V) in all phases of the timing operation; and the first reset signal line in the pixel driving circuit according to the present disclosure is provided with a first initialization voltage (e.g., at a level of −3 V) in the initial phase, the reset phase, the data write phase; and a voltage maintaining voltage (e.g., at a level of 3 V) in the voltage maintaining phase and the light emitting phase.

TABLE 1

Reduction of the voltage leakage in a pixel driving circuit according to the present disclosure as compared to a reference pixel driving circuit.

| | | | $V_{leakage}$ | | Percetage of $V_{leakage}$ |
|---|---|---|---|---|---|
| $V_{Data}$ | $V_{Anode}$ | Gtd | Reference PDC | Present PDC | Reduction |
| 1.8 V | 2.41 V | 0.31 V | 55.85 mV | 23.38 mV | 58.14% |
| 4.2 V | 0.32 V | 2.20 V | 63.61 mV | 4.72 mV | 92.58% |
| 6.6 V | −2.99 V | 4.48 V | 103.55 mV | 63.04 mV | 39.12% |

In Table 1, $V_{Data}$ stands for a voltage level of the data voltage signal, $V_{Anode}$ stands for a voltage level measured at the anode of the light emitting element, and Gtd stands for a voltage level measured at the node N1 connecting the gate electrode of the driving transistor and the second capacitor electrode, $V_{leakage}$ stands for the measured value of voltage leakage between the drain electrode and the source electrode of the first reset transistor. As shown in Table 1, the voltage leakage in the present pixel driving circuit can be reduced by as much as 92.58% ($V_{Data}$=4.2 V). Optionally, the voltage leakage can be reduced by at least 40% ($V_{Data}$=6.6 V).

Accordingly, in some embodiment, the first reset transistor Tr1 is configured to be turned on to allow a first initialization voltage signal Vint1 provided by the first reset signal line SLr1 to be written into the second capacitor electrode Ce2 in the reset phase II; the first reset transistor Tr1 is configured to be turned off and the first reset signal line SLr1 is configured to provide a voltage maintaining signal Vvm to the source electrode of the first reset transistor Tr1 in the voltage maintaining phase IV. The voltage maintaining signal Vvm is different from the first initialization voltage signal Vint1. Optionally, the voltage maintaining signal Vvm is closer to the voltage level Gtd in the light emitting phase V as compared to the first initialization voltage signal Vint1. Optionally, a first voltage difference between the voltage maintaining signal Vvm and the voltage level Gtd in the light emitting phase V is smaller than a second voltage difference between the first initialization voltage signal Vint1 in the data write phase III and the voltage level Gtd in the light emitting phase V. Optionally, the first voltage difference is smaller than the second voltage difference by at least 20%, e.g., by at least 30%, by at least 40%, by at least 50%, by at least 60%, by at least 70%, by at least 80%, by at least 90%, or by at least 1000%.

Similarly, in some embodiments, the voltage maintaining signal Vvm is different from the second initialization voltage signal Vint2. Optionally, the voltage maintaining signal Vvm is closer to the voltage level Gtd in the light emitting phase V as compared to the second initialization voltage signal Vint2. Optionally, the first voltage difference between the voltage maintaining signal Vvm and the voltage level Gtd in the light emitting phase V is smaller than a third voltage difference between the second initialization voltage signal Vint2 in the data write phase III and the voltage level Gtd in the light emitting phase V. Optionally, the first voltage difference is smaller than the third voltage difference by at least 20%, e.g., by at least 30%, by at least 40%, by at least 50%, by at least 60%, by at least 70%, by at least 80%, by at least 90%, or by at least 1000%.

Optionally, the first initialization voltage signal Vint1 and the second initialization voltage signal Vint2 are substantially same. As used herein, the term "substantially the same" refers to a difference between two values not exceeding 10% of a base value (e.g., one of the two values), e.g., not exceeding 8%, not exceeding 6%, not exceeding 4%, not exceeding 2%, not exceeding 1%, not exceeding 0.5%, not exceeding 0.1%, not exceeding 0.05%, and not exceeding 0.01%, of the base value.

The first reset signal line SLr1 and the second reset signal line SLr2 are independent of each other. Optionally, the second reset signal line SLr2 is provided with the second initialization voltage signal Vint2 which is constant in all phases of the operation, including the initial phase I, the reset phase II, the data write phase III, the voltage maintaining phase IV, and the light emitting phase V. Optionally, the first reset signal line SLr1 is provided with the first initialization voltage signal Vint1 in the initial phase I, the reset phase II, and the data write phase III; and is provided with the voltage maintaining signal Vvm in the voltage maintaining phase IV and the light emitting phase V. Optionally, second reset signal lines connected to a plurality of pixel driving circuits respectively in a plurality of subpixels in the display panel are commonly connected to a common power supply source.

Figure 5:
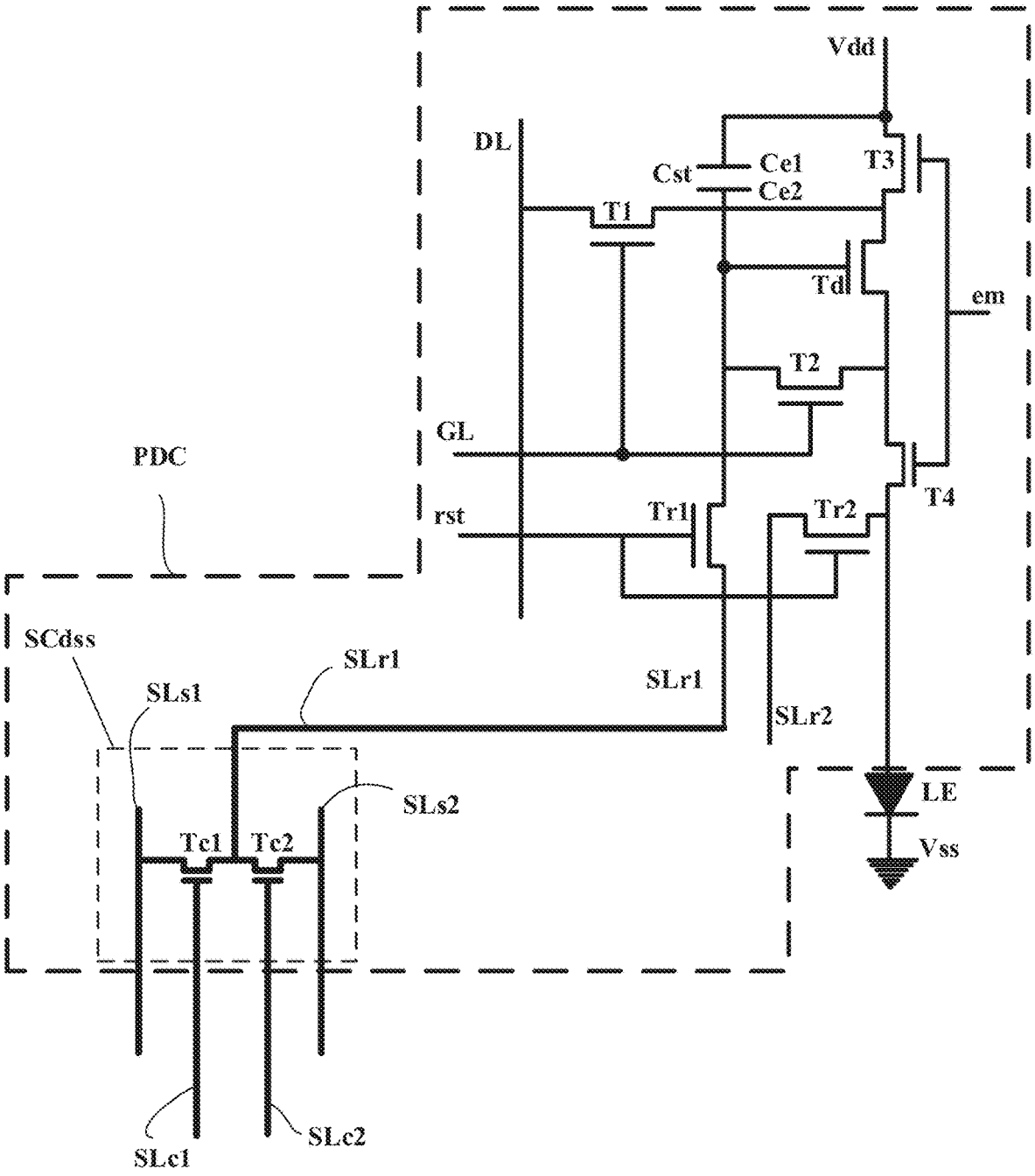
FIG. 5 is a circuit diagram illustrating the structure of a pixel driving circuit in some embodiments according to the present disclosure.
Figure 6:
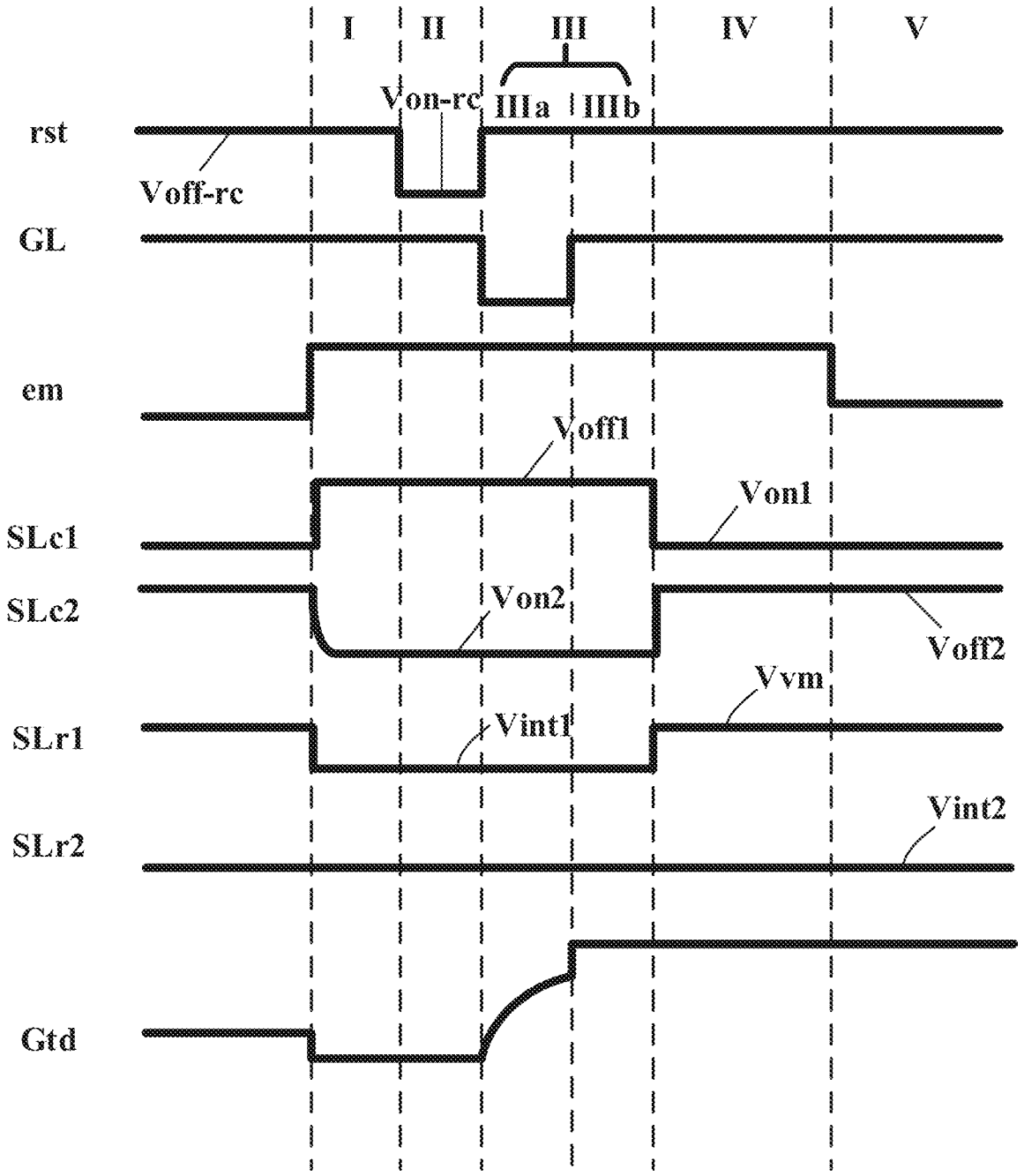
FIG. 6 is a timing diagram of operating a display panel having a pixel driving circuit in some embodiments according to the present disclosure.

FIG. 5 is a circuit diagram illustrating the structure of a pixel driving circuit in some embodiments according to the present disclosure. FIG. 6 is a timing diagram of operating a display panel having a pixel driving circuit in some embodiments according to the present disclosure. Referring to FIG. 5 and FIG. 6, in some embodiments, the pixel driving circuit further includes a dual signal switch sub-circuit SCdss connected to the first reset signal line SLr1. The dual signal switch sub-circuit SCdss is configured to generate the first initialization voltage signal Vint1 in the reset phase II, and generate the voltage maintaining signal Vvm in the voltage maintaining phase IV. Optionally, the dual signal switch sub-circuit SCdss is configured to generate the first initialization voltage signal Vint1 in the initial phase I, the reset phase II, the data write phase III; and generate the voltage maintaining signal Vvm in the voltage maintaining phase IV and the light emitting phase V.

In some embodiments, the dual signal switch sub-circuit SCdss includes a first control transistor Tc1 and a second control transistor Tc2. Optionally, the first control transistor Tc1 includes a gate electrode connected to a first control signal line SLc1, a source electrode connected to a first switch signal line SLs1 configured to provide the voltage maintaining signal Vvm, and a drain electrode connected to the first reset signal line SLr1. Optionally, the second control transistor Tc2 includes a gate electrode connected to a second control signal line SLc2, a source electrode connected to a second switch signal line SLs2 configured to provide the first initialization voltage signal Vint1, and a drain electrode connected to the first reset signal line SLr1. In the reset phase II and the data write phase III, the first control transistor Tc1 is configured to be turned off, and the second control transistor Tc2 is configured to be turned on. Optionally, in the initial phase I, the reset phase II, and the data write phase III, the first control transistor Tc1 is configured to be turned off, and the second control transistor Tc2 is configured to be turned on. In the voltage maintaining phase IV, the first control transistor Tc1 is configured to be turned on, and the second control transistor Tc2 is configured to be turned off. Optionally, in the voltage maintaining phase IV and the light emitting phase V, the first control transistor Tc1 is configured to be turned on, and the second control transistor Tc2 is configured to be turned off.

Referring to FIG. 5 and FIG. 6, in at least one of the initial phase I, the reset phase II, and the data write phase III, a first turning-off control signal Voff1 is provided through a first control signal line SLc1 to a gate electrode of a first control transistor Tc1 to turn off the first control transistor Tc1 of the dual signal switch sub-circuit SCdss. The first initialization voltage signal Vint1 is provided through a second switch signal line SLs2 to a source electrode of a second control transistor Tc1. A second turning-on control signal Von2 is provided through a second control signal line SLc2 to a gate electrode of the second control transistor Tc2 to turn on the second control transistor Tc2 of the dual signal switch sub-circuit SCdss, thereby allowing the first initialization voltage signal Vint1 to pass from the source electrode of the second control transistor Tc2 to a drain electrode of the second control transistor Tc2, and in turn to the first reset signal line SLr1 connected to the drain electrode of the second control transistor Tc2. The first reset signal line SLr1 is configured to provide the first initialization voltage signal Vint1 to the first reset transistor Tr1 in in at least one of the initial phase I, the reset phase II, and the data write phase III.

In at least one of the voltage maintaining phase IV and the light emitting phase V, a second turning-off control signal Voff2 is provided through a second control signal line SLc2 to a gate electrode of a second control transistor Tc2 to turn off the second control transistor Tc2 of the dual signal switch sub-circuit SCdss. The voltage maintaining signal Vvm is provided through a first switch signal line SLs1 to a source electrode of a first control transistor Tc1. A first turning-on control signal Von1 is provided through the first control signal line SLc1 to the gate electrode of the first control transistor Tc1 to turn on the first control transistor Tc1 of the dual signal switch sub-circuit SCdss, thereby allowing the voltage maintaining signal Vvm to pass from the source electrode of the first control transistor Tc1 to a drain electrode of the first control transistor Tc1, and in turn to the first reset signal line SLr1 connected to the drain electrode of the first control transistor Tc1. The first reset signal line SLr1 is configured to provide the voltage maintaining signal Vvm to the first reset transistor Tr1 in in at least one of the voltage maintaining phase IV and the light emitting phase V. Timing of other control signals (the reset control signal line rst, the gate line GL, the light emitting control signal line em, the voltage level Gtd, the first reset signal line SLr1, and the second reset signal line SLr2) are largely similar to those depicted in FIG. 4 and associated texts.

Figure 7:
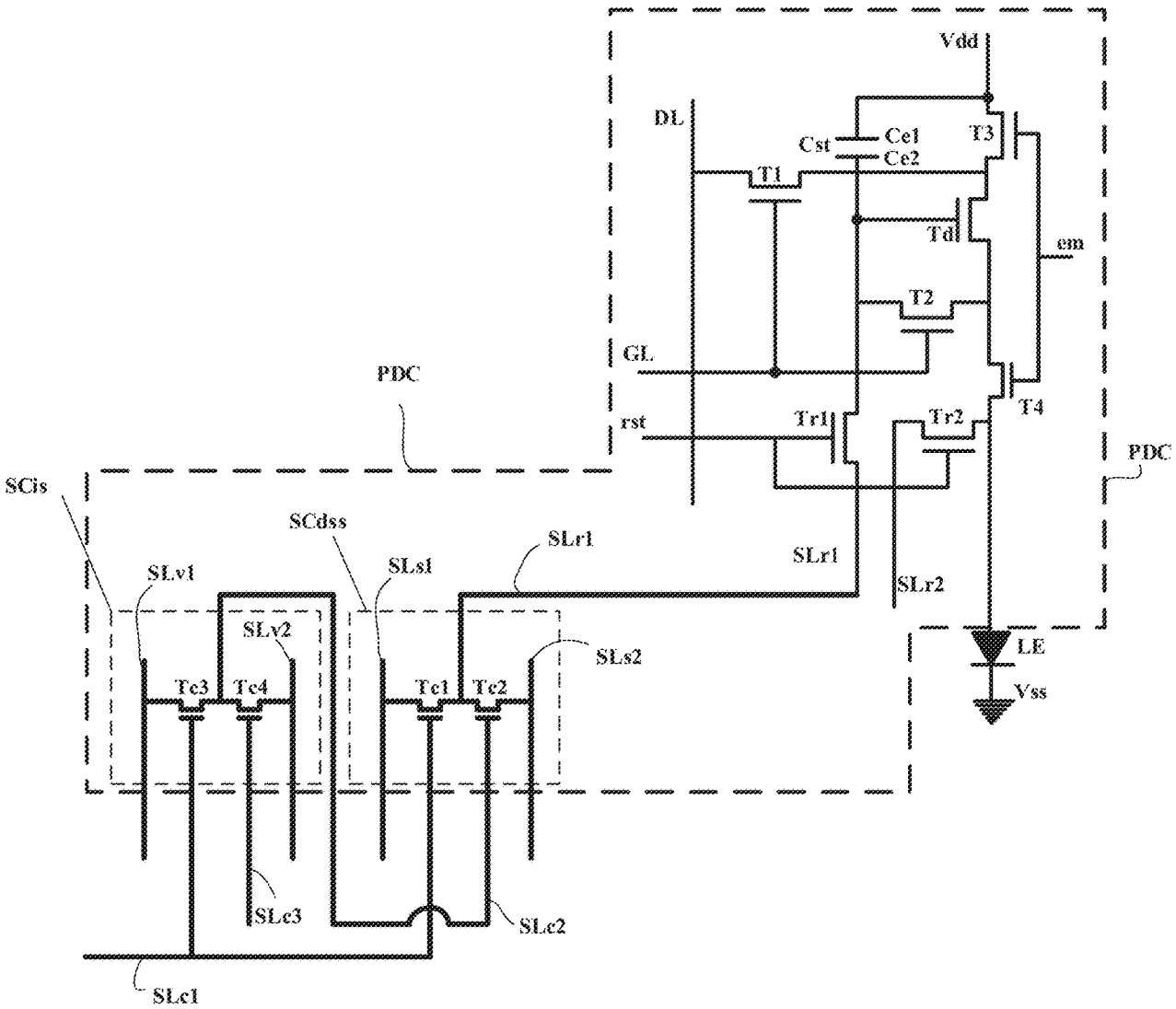
FIG. 7 is a circuit diagram illustrating the structure of a pixel driving circuit in some embodiments according to the present disclosure.
Figure 8:
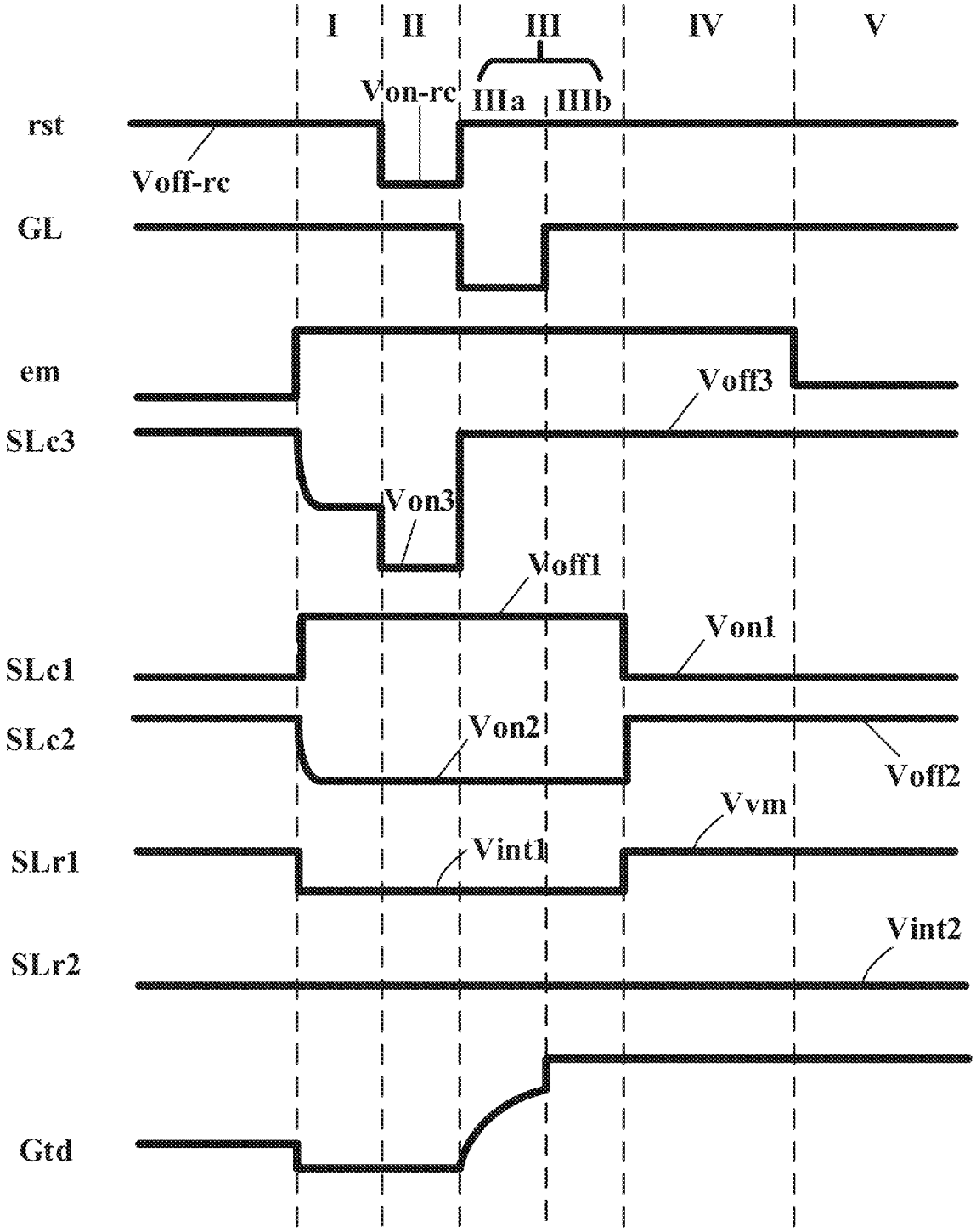
FIG. 8 is a timing diagram of operating a display panel having a pixel driving circuit in some embodiments according to the present disclosure.

FIG. 7 is a circuit diagram illustrating the structure of a pixel driving circuit in some embodiments according to the present disclosure. FIG. 8 is a timing diagram of operating a display panel having a pixel driving circuit in some embodiments according to the present disclosure. Referring to FIG. 7 and FIG. 8, in some embodiments, the pixel driving circuit further includes an inverse switch sub-circuit SCis connected to the dual signal switch sub-circuit SCdss. In at least one of the initial phase I, the reset phase II, and the data write phase III, the inverse switch sub-circuit SCis is configured to generate a first turning-off control signal Voff1 through a first control signal line SLc1 to a gate electrode of a first control transistor Tc1 to turn off the first control transistor Tc1 of the dual signal switch sub-circuit SCdss, and generate a second turning-on control signal Von2 through a second control signal line SLc2 to a gate electrode of the second control transistor Tc2 to turn on a second control transistor Tc2 of the dual signal switch sub-circuit SCdss. In at least one of the voltage maintaining phase IV and the light emitting phase V, the inverse switch sub-circuit SCis is configured to generate a first turning-on control signal Von1 through the first control signal line SLc1 to the gate electrode of the first control transistor Tc1 to turn on the first control transistor Tc1 of the dual signal switch sub-circuit SCdss, and generate a second turning-off control signal Voff2 through a second control signal line SLc2 to a gate electrode of a second control transistor Tc2 to turn off the second control transistor Tc2 of the dual signal switch sub-circuit SCdss.

In some embodiments, the inverse switch sub-circuit SCis includes a third control transistor Tc3 and a fourth control transistor Tc4. Optionally, the third control transistor Tc3 includes a gate electrode connected to the first control signal line SLc1, a source electrode connected to a first voltage signal line SLv1 configured to provide a first voltage signal (e.g., a high voltage signal), and a drain electrode connected to the second control signal line SLc2. Optionally, the fourth control transistor Tc4 includes a gate electrode connected to a third control signal line SLc3, a source electrode connected to a second voltage signal line SLv2 configured to provide a second voltage signal (e.g., a low voltage signal), and a drain electrode connected to the second control signal line SLc2.

The first control signal line SLc1 is connected to both the gate electrode of the third control transistor Tc3 and the gate electrode of the first control transistor Tc1. The second control signal line SLc2 is connected to drain electrodes of the third control transistor Tc3 and the fourth control transistor Tc4, and the gate electrode of the second control transistor Tc2.

In the reset phase II and the data write phase III, the third control transistor Tc3 is configured to be turned off, and the fourth control transistor Tc4 is configured to be turned on. Optionally, in the initial phase I, the reset phase II, and the data write phase III, the third control transistor Tc3 is configured to be turned off, and the fourth control transistor Tc4 is configured to be turned on. In the voltage maintaining phase IV, the third control transistor Tc3 is configured to be turned on, and the fourth control transistor Tc4 is configured to be turned off. Optionally, in the voltage maintaining phase IV and the light emitting phase V, the third control transistor Tc3 is configured to be turned on, and the fourth control transistor Tc4 is configured to be turned off.

Referring to FIG. 7 and FIG. 8, in at least one of the initial phase I, the reset phase II, and the data write phase III, the first turning-off control signal Voff1 is provided through the first control signal line SLc1 to a gate electrode of the third control transistor Tc3 of the inverse switch sub-circuit SCis to turn off the third control transistor Tc3 of the inverse switch sub-circuit SCis connected to the dual signal switch sub-circuit SCdss, and simultaneously to the gate electrode of the first control transistor Tc1 to turn off the first control transistor Tc1. A second voltage signal (e.g., a low voltage signal) is provided through a second voltage signal line SLv2 to a source electrode of a fourth control transistor Tc4 of the inverse switch sub-circuit SCis. A third turning-on control signal Von3 is provided through a third control signal line SLc3 to a gate electrode of the fourth control transistor Tc4 of the inverse switch sub-circuit SCis to turn on the fourth control transistor Tc4 of the inverse switch sub-circuit SCis, thereby allowing the second voltage signal to pass from the source electrode of the fourth control transistor Tc4 to a drain electrode of the fourth control transistor Tc4, and in turn to the second control signal line SLc2 connected to the gate electrode of the second control transistor Tc2. The second voltage signal (e.g., a low voltage signal line) is used as the second turning-on control signal Von2 to turn on the second control transistor Tc2 in at least one of the initial phase I, the reset phase II, and the data write phase III.

In at least one of the voltage maintaining phase IV and the light emitting phase V, a third turning-off control signal Voff3 is provided through a third control signal line SLc3 to a gate electrode of a fourth control transistor Tc4 of the inverse switch sub-circuit SCis to turn off the fourth control transistor Tc4. A first voltage signal (e.g., a high voltage signal) is provided through a first voltage signal line SLv1 to a source electrode of a third control transistor Tc3 of an inverse switch sub-circuit SCis connected to the dual signal switch sub-circuit SCdss. The first turning-on control signal Von1 is provided through the first control signal line SLc1 to a gate electrode of the third control transistor Tc3 to turn on the third control transistor Tc3, thereby allowing the first voltage signal (e.g., a high voltage signal) to pass from the source electrode of the third control transistor Tc3 to a drain electrode of the third control transistor Tc3, and in turn to the second control signal line SLc2 connected to the gate electrode of the second control transistor Tc2. The first voltage signal (e.g., a high voltage signal) is used as the second turning-off control signal Voff2 to turn off the second control transistor Tc2 in in at least one of the voltage maintaining phase IV and the light emitting phase V. Timing of other control signals (the reset control signal line rst, the gate line GL, the light emitting control signal line em, the voltage level Gtd, the first reset signal line SLr1, the second reset signal line SLr2, the first control signal line SLc1, and the second control signal line SLc2) are largely similar to those depicted in FIG. 4 and FIG. 6, and associated texts.

Referring to FIG. 8, the third turning-on control signal Von3 has different voltage levels in the initial phase I and the reset phase II. The voltage level of the third turning-on control signal Von3 in the reset phase II is lower than the voltage level of the third turning-on control signal Von3 in the initial phase I.

Figure 9:
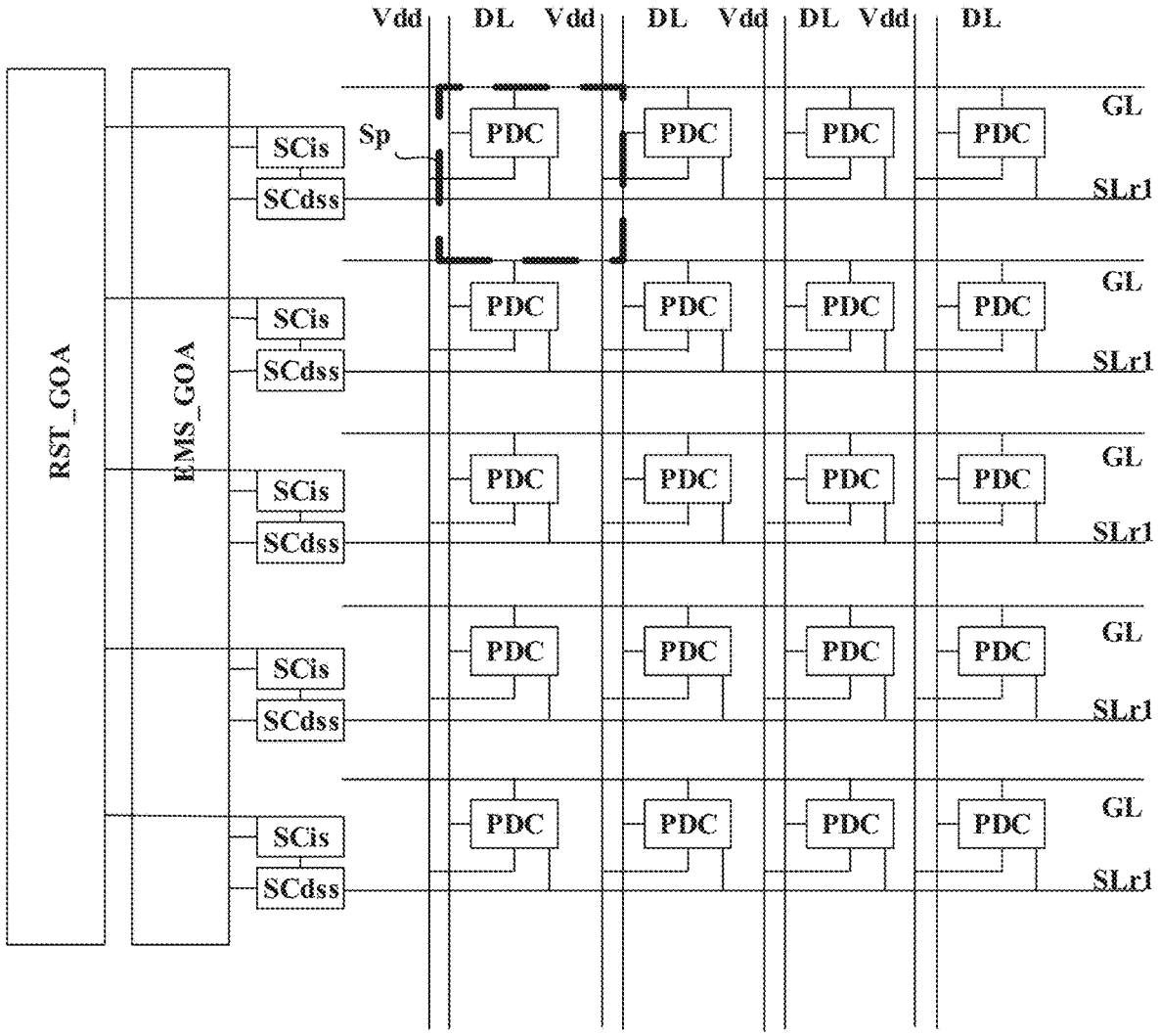
FIG. 9 is a circuit diagram illustrating the structure of a pixel driving circuit in some embodiments according to the present disclosure.
Figure 10:
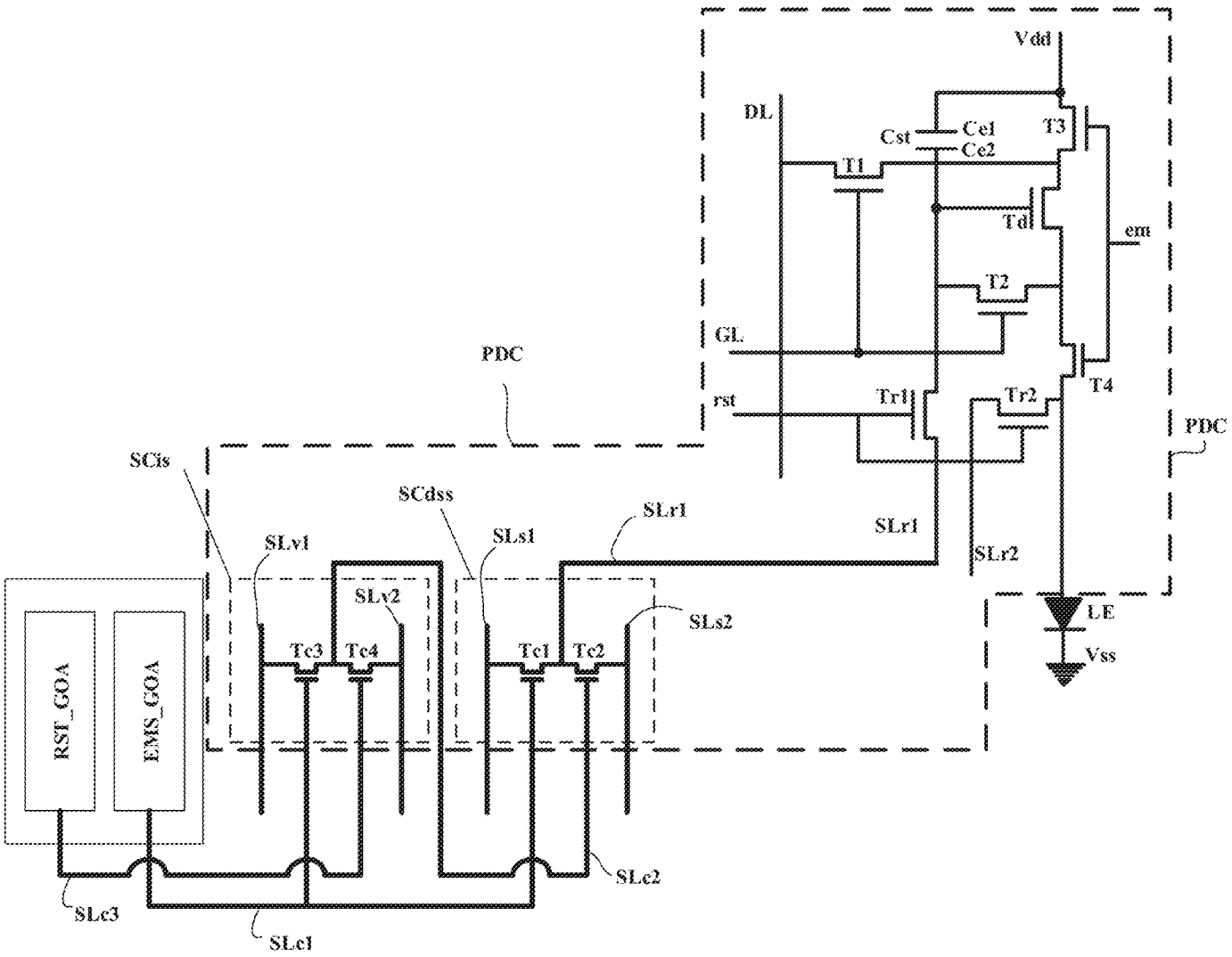
FIG. 10 is a schematic diagram illustrating the structure of a display apparatus in some embodiments according to the present disclosure.
Figure 11:
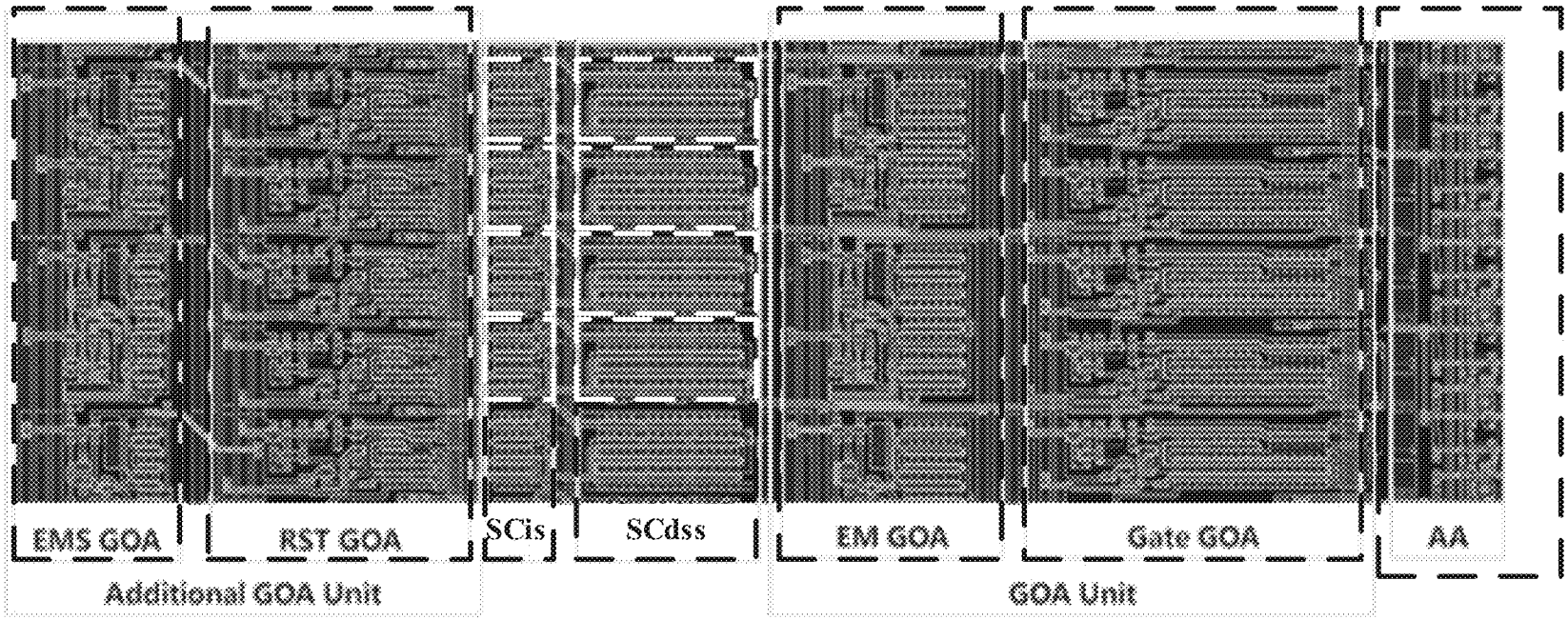
FIG. 11 is an image of a layout of a peripheral region of a display apparatus in some embodiments according to the present disclosure.

In another aspect, the present disclosure further provides a display apparatus including the pixel driving circuit described herein, a first control gate-on-array circuit connected to the third control signal line, and a second control gate-on-array circuit connected to the first control signal line. FIG. 9 is a circuit diagram illustrating the structure of a pixel driving circuit in some embodiments according to the present disclosure. FIG. 10 is a schematic diagram illustrating the structure of a display apparatus in some embodiments according to the present disclosure. FIG. 11 is an image of a layout of a peripheral region of a display apparatus in some embodiments according to the present disclosure. Referring to FIG. 9 to FIG. 11, in some embodiments, the display apparatus displays images in the plurality of subpixels row-by-row. Accordingly, each row of pixel driving circuits for driving a respective row of subpixels is connected to a dual signal switch sub-circuit SCdss and an inverse switch sub-circuit SCis. To achieve scanning of first reset signal line in a row-by-row fashion, the display apparatus includes additional gate-on-array units such as a first control gate-on-array circuit RST_GOA connected to the third control signal line SLc3, and a second control gate-on-array circuit EMS_GOA connected to the first control signal line SLc1. The display apparatus further includes a gate scanning gate-on-array circuit Gate_GOA connected to a plurality of rows of gate lines and a light emitting scanning gate-on-array circuit EM_GOA connected to a plurality of rows of light emitting control signal lines.

FIG. 11 shows an example in which the second control gate-on-array circuit EMS_GOA, the first control gate-on-array circuit RST_GOA, the inverse switch sub-circuit SCis, the dual signal switch sub-circuit SCdss, the light emitting scanning gate-on-array circuit EM_GOA, and the gate scanning gate-on-array circuit Gate_GOA are arranged sequentially. Various alternative arrangements may be implemented in which the sequence of various circuits may be varied.

The first control gate-on-array circuit RST_GOA is configured to generate the signals for the third control signal line SLc3 in each row of the plurality of rows of pixel driving circuits. Referring to FIG. 8 and FIG. 10, the third turning-on control signal Von3 has different voltage levels in the initial phase I and the reset phase II. The voltage level of the third turning-on control signal Von3 in the reset phase II is lower than the voltage level of the third turning-on control signal Von3 in the initial phase I. In the initial phase I, the third turning-on control signal Von3 is at a voltage level of ($V_{GL}$−Vth), wherein the Vth is a threshold voltage of the driving transistor Td, and the $V_{GL}$ is a second voltage signal provided to the second voltage signal line SLv2. In the reset phase II, due to the boost function of the first control gate-on-array circuit RST_GOA, the third turning-on control signal Von3 is further lowered to a voltage level of ($2V_{GL}$−$V_{GH}$−Vth), wherein the Vth is a threshold voltage of the driving transistor Td, the $V_{GH}$ is a first voltage signal provided to the first voltage signal line SLv1, and the $V_{GL}$ is a second voltage signal provided to the second voltage signal line SLv2. Thus, in the reset phase II, the third turning-on control signal Von3 is much lower than a voltage level of $V_{GL}$, facilitating turning-on of the fourth control transistor Tc4 sufficiently.

In some embodiments, the display apparatus includes a plurality of rows of pixel driving circuits. The pixel driving circuit described herein is a pixel driving circuit in a respective row of the plurality of rows of pixel driving circuits. Optionally, the respective row of the plurality of rows of pixel driving circuits is connected to the dual signal switch sub-circuit and the inverse switch sub-circuit. Optionally, the dual signal switch sub-circuit is configured to generate the first initialization voltage signal in the reset phase, and generate the voltage maintaining signal in the voltage maintaining phase for the respective row of the plurality of rows of pixel driving circuits.

Figure 12:
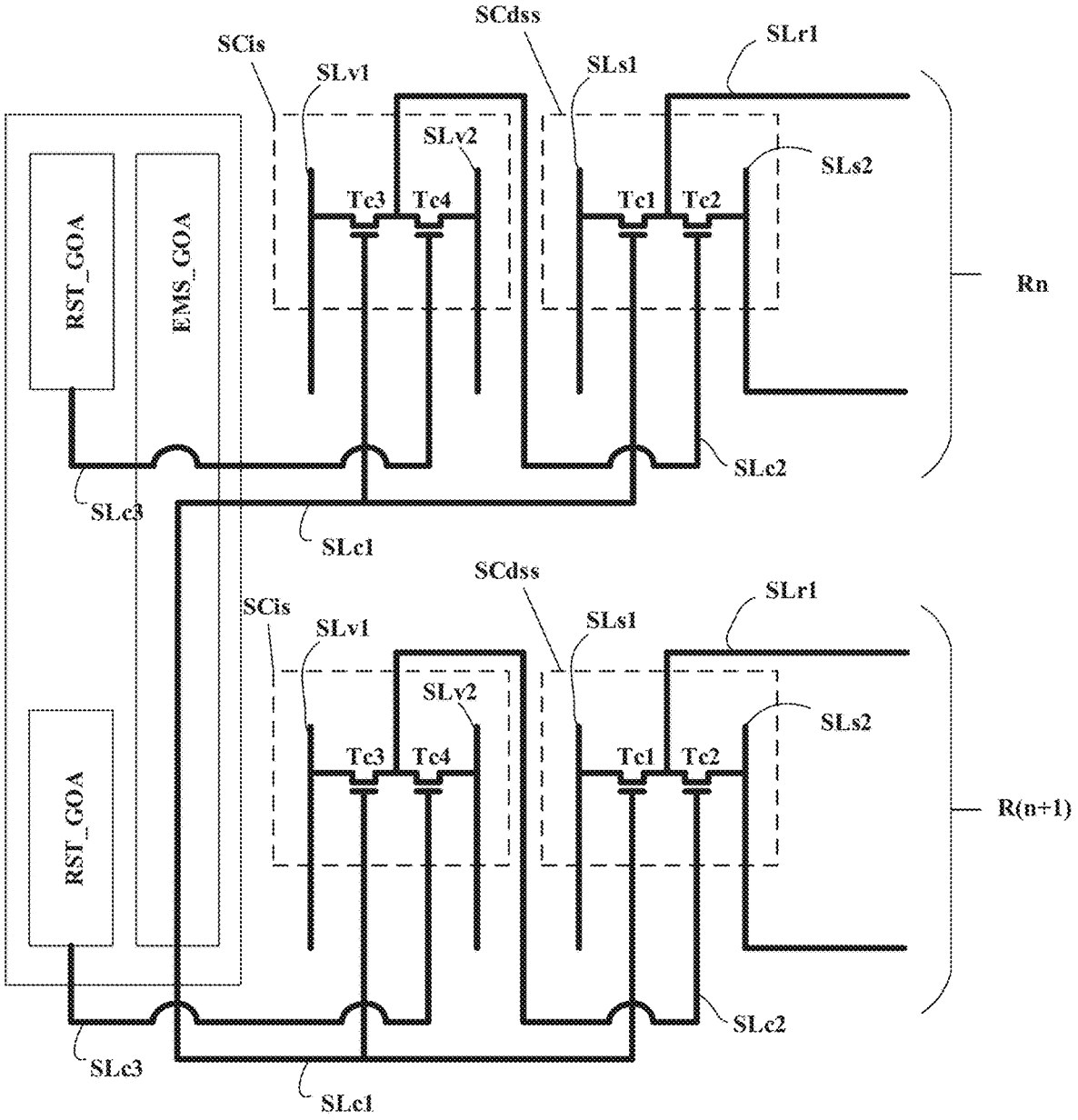
FIG. 12 is a circuit diagram illustrating the structure of a plurality of rows of pixel driving circuits in some embodiments according to the present disclosure.
Figure 13:
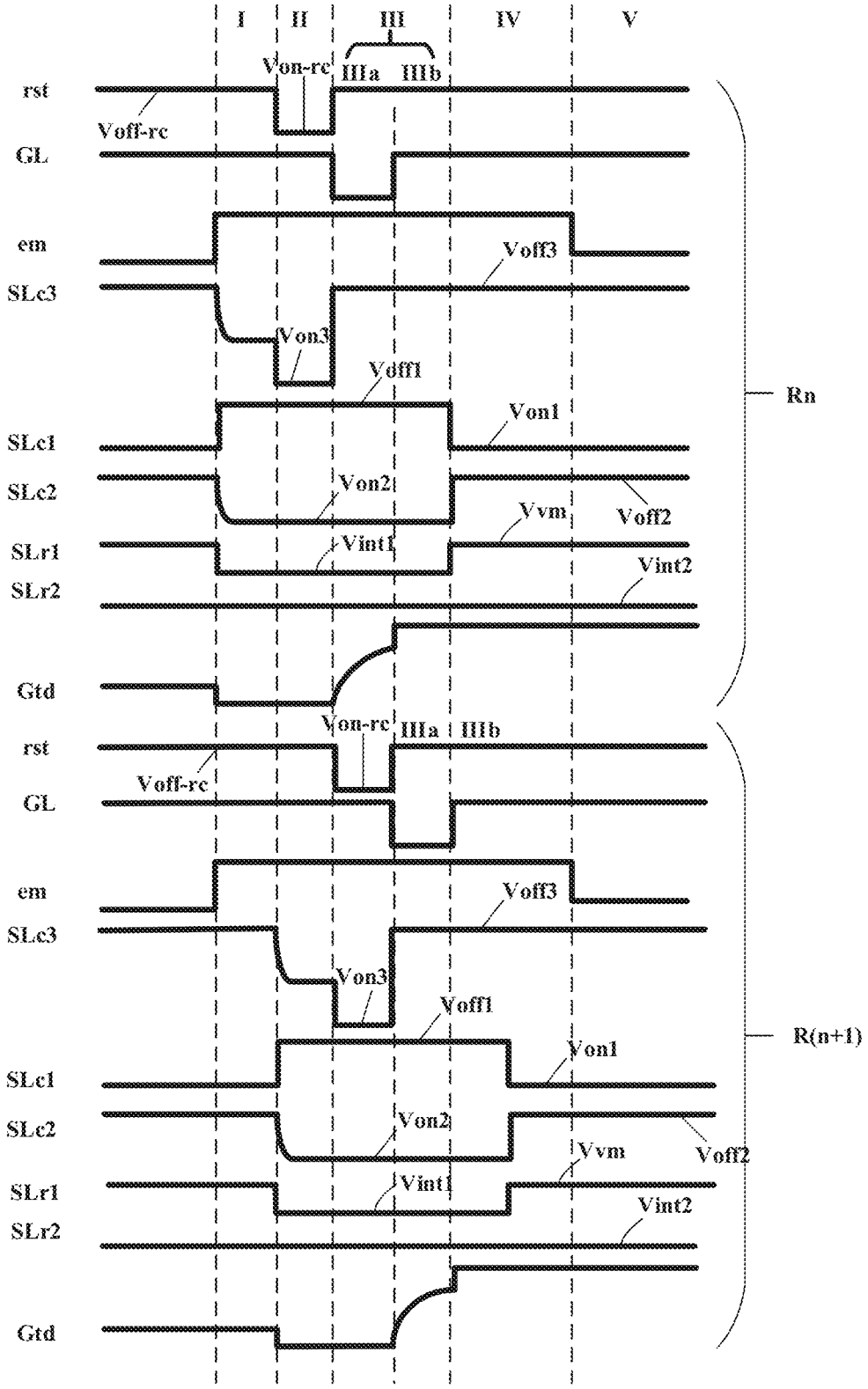
FIG. 13 is a timing diagram of operating a display panel having a pixel driving circuit in some embodiments according to the present disclosure.

FIG. 12 is a circuit diagram illustrating the structure of a plurality of rows of pixel driving circuits in some embodiments according to the present disclosure. FIG. 13 is a timing diagram of operating a display panel having a pixel driving circuit in some embodiments according to the present disclosure. Referring to FIG. 12 and FIG. 13, a respective row Rn of the plurality of rows of pixel driving circuits and a next adjacent row R(n+1) are shown. Each row of the plurality of rows of pixel driving circuits (e.g., the respective row Rn and the next adjacent row R(n+1)) is connected to a set of the inverse switch sub-circuit SCis and the dual signal switch sub-circuit SCdss for receiving the first initialization voltage signal in the reset phase, and the voltage maintaining signal in the voltage maintaining phase. Each row of the plurality of rows of pixel driving circuits (e.g., the respective row Rn and the next adjacent row R(n+1) is connected to an individual one of the first control gate-on-array circuit RST_GOA, which provides the third turning-off control signal Voff3 and the third turning-on control signal Von3. The plurality of rows of pixel driving circuits (e.g., the respective row Rn and the next adjacent row R(n+1)), however, are commonly connected to a single one of the second control gate-on-array circuit EMS_GOA, which provides the first turning-on control signal Von1 and the first turning-off control signal Voff1 to the inverse switch sub-circuit SCis and the dual signal switch sub-circuit SCdss in the plurality of rows of pixel driving circuits (e.g., the respective row Rn and the next adjacent row R(n+1)).

In some embodiments, each of the light emitting scanning gate-on-array circuit EM_GOA and the second control gate-on-array circuit EMS_GOA, the gate scanning gate-on-array circuit Gate_GOA, and the first control gate-on-array circuit RST_GOA includes a plurality of shift registers connected in cascade.

Figure 14:
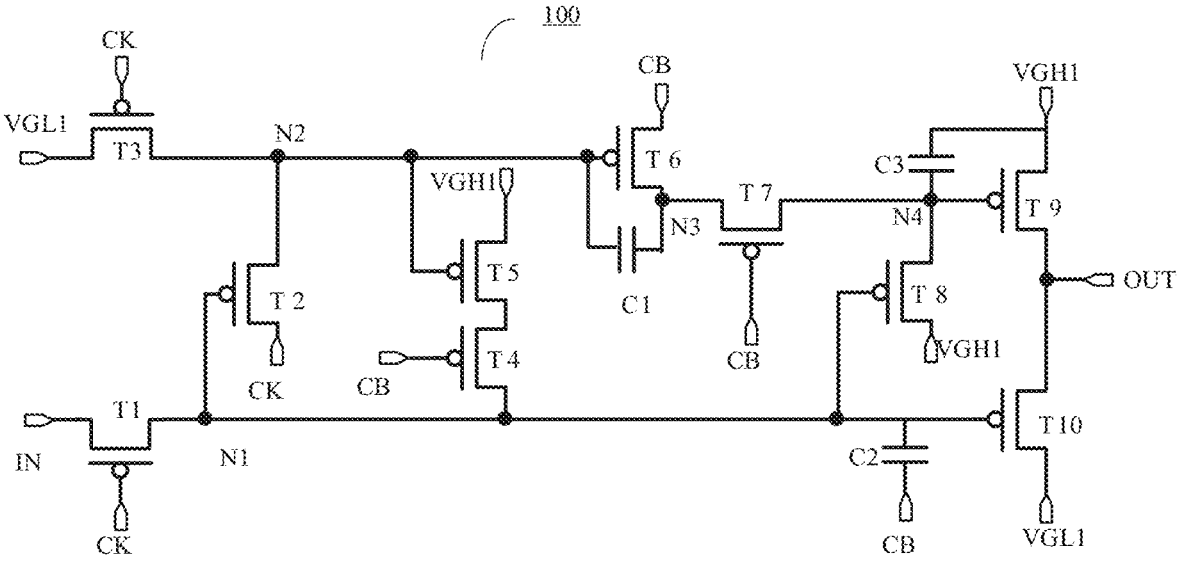
FIG. 14 is a circuit diagram of a light-emitting control shift register.
Figure 15:
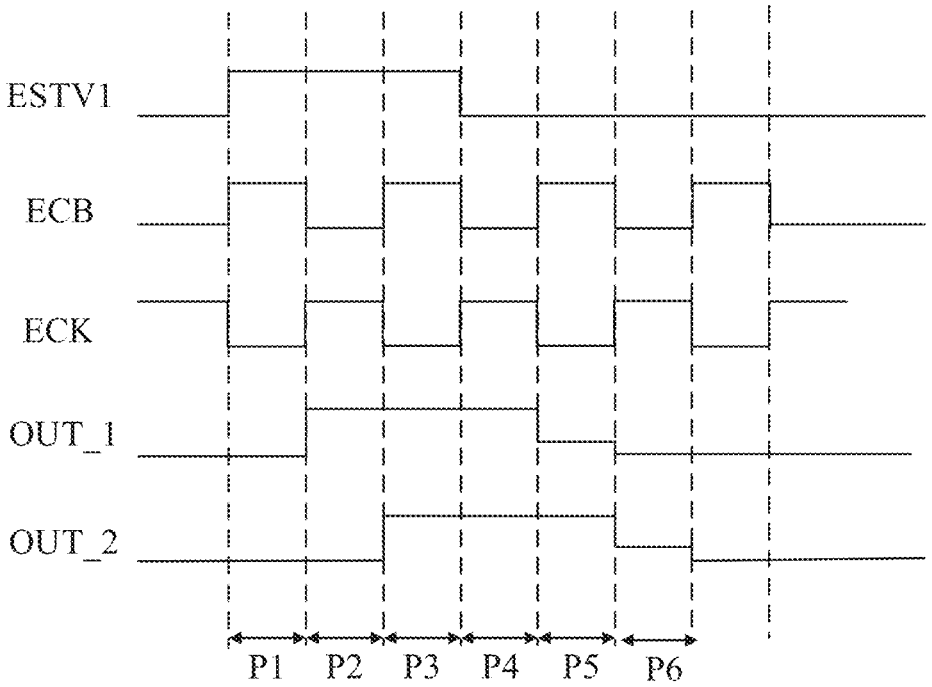
FIG. 15 is a timing diagram of signals in a case where the light-emitting control shift register as shown in FIG. 14 operates.

FIG. 14 is a circuit diagram of a light-emitting control shift register. The light-emitting control shift register as shown in FIG. 14 is representative of a respective shift register in the light emitting scanning gate-on-array circuit EM_GOA or a respective shift register in the second control gate-on-array circuit EMS_GOA, in some examples of the present disclosure. FIG. 15 is a timing diagram of signals in a case where the light-emitting control shift register as shown in FIG. 14 operates. An operation process of the light-emitting control shift register will be briefly described below with reference to FIG. 14 and FIG. 15.

As shown in FIG. 14, the light-emitting control shift register 100 comprises ten transistors (a first transistor T1, a second transistor T2, . . . , a tenth transistor T10) and three capacitors (a first capacitor C1, a second capacitor C2, and a third capacitor C3). For example, in a case where a plurality of light-emitting control shift registers are cascaded, a first electrode of a first transistor T1 in a first-stage light-emitting control shift register 100 is configured to be connected to a first trigger signal line ESTV1 to receive a first trigger signal ESTV1, a first electrode of a first transistor T1 in each of the other stages of the light-emitting control shift registers 100 is connected to a previous-stage light-emitting control shift register 100, to receive a first output signal EM outputted by the previous-stage light-emitting control shift register 100.

In addition, in FIG. 14 and FIG. 15, CK represents a first clock signal terminal, ECK represents a first clock signal line and a first clock signal, and the first clock signal terminal CK is connected to the first clock signal line ECK to receive the first clock signal; CB represents a second clock signal terminal, ECB represents a second clock signal line and a second clock signal, and the second clock signal terminal CB is connected to the second clock signal line ECB to receive the second clock signal, for example, the first clock signal ECK and the second clock signal ECB may use a pulse signal with a duty ratio greater than 50%; and VGH1 represents a first power line and a first power voltage provided by the first power line. For example, the first power voltage is a DC high level voltage, and VGL1 represents a third power line and a second power voltage provided by the third power line, for example, the second power voltage is a DC low level voltage, and the first power voltage is greater than the second power voltage; and N1, N2, N3, and N4 represent a first node, a second node, a third node, and a fourth node, respectively.

As shown in FIG. 14, a gate electrode of the first transistor T1 is connected to the first clock signal terminal CK (i.e., the first clock signal line ECK) to receive the first clock signal, a first electrode of the first transistor T1 is connected to an input terminal IN, and a second electrode of the first transistor T1 is connected to the first node N1. For example, in a case where the light-emitting control shift register is a first-stage shift register, the input terminal IN is connected to a first trigger signal line ESTV1 to receive a first trigger signal, in a case where the light-emitting control shift register is a shift register other than the first-stage shift register, the input terminal IN of the light-emitting control shift register is connected to an output terminal OUT of the previous-stage light-emitting control shift register of the light-emitting control shift register.

A gate electrode of the second transistor T2 is connected to the first node N1, a first electrode of the second transistor T2 is connected to the first clock signal line ECK to receive the first clock signal, and a second electrode of the second transistor T2 is connected to the second node N2.

A gate electrode of a third transistor T3 is connected to the first clock signal line ECK to receive the first clock signal, a first electrode of the third transistor T3 is connected to the third power line VGL1 to receive the second power voltage, and a second electrode of the third transistor T3 is connected to the second node N2.

A gate electrode of a fourth transistor T4 is connected to the second clock signal terminal CB (i.e., the second clock signal line ECB) to receive the second clock signal, a first electrode of the fourth transistor T4 is connected to the first node N1, and a second electrode of the fourth transistor T4 is connected to a first electrode of the fifth transistor T5.

A gate electrode of a fifth transistor T5 is connected to the second node N2, and a second electrode of the fifth transistor T5 is connected to the first power line VGH to receive the first power voltage.

A gate electrode of a sixth transistor T6 is connected to the second node N2, a first electrode of the sixth transistor T6 is connected to the second clock signal line ECB to receive the second clock signal, and a second electrode of the sixth transistor T6 is connected to the third node N3.

A first terminal of the first capacitor C1 is connected to the second node N2, and a second terminal of the first capacitor C1 is connected to the third node N3.

A gate electrode of a seventh transistor T7 is connected to the second clock signal line ECB to receive the second clock signal, a first electrode of the seventh transistor T7 is connected to the third node N3, and a second electrode of the seventh transistor T7, is connected to the fourth node N4.

A gate electrode of an eighth transistor T8 is connected to the first node N1, a first electrode of the eighth transistor T8 is connected to the first power line VGH1 to receive the first power voltage, and a second electrode of the eighth transistor T8 is connected to the fourth node N4.

A gate electrode of a ninth transistor T9 is connected to the fourth node N4, a first electrode of the ninth transistor T9 is connected to the first power line VGH1 to receive the first power voltage, and a second electrode of the ninth transistor T9 is connected to the output terminal OUT.

A first terminal of the third capacitor C3 is connected to the fourth node N4, and a second terminal of the third capacitor C3 is connected to the first power line VGH1 to receive the first power voltage.

A gate electrode of the tenth transistor T10 is connected to the first node N1, a first electrode of the tenth transistor T10 is connected to the third power line VGL1 to receive the second power voltage, and a second electrode of the tenth transistor T10 is connected to the output terminal OUT.

A first terminal of the second capacitor C2 is connected to the second clock signal line ECB to receive the second clock signal, and a second terminal of the second capacitor C2 is connected to the first node N1.

Transistors in the light-emitting control shift register 100 as shown in FIG. 14 are all described by taking P-type transistors as an example, that is, each transistor is turned on in a case where a gate electrode of each transistor is connected to a low level, and each transistor is turned off in a case where the gate electrode of each transistor is connected to a high level. In this case, the first electrode may be a source electrode, and the second electrode may be a drain electrode.

The embodiment of the present disclosure comprises, but is not limited to, the configuration as shown in FIG. 14, for example, respective transistors in the light-emitting control shift register 100 as shown in FIG. 14 may also be N-type transistors or may be P-type transistors and N-type transistors, as long as port polarities of a selected-type of transistor are correspondingly connected in accordance with port polarities of a corresponding transistor in the embodiments of the present disclosure.

As discussed above, the light-emitting control shift register as shown in FIG. 14 is representative of a respective shift register in the light emitting scanning gate-on-array circuit EM_GOA or a respective shift register in the second control gate-on-array circuit EMS_GOA, in some examples of the present disclosure. In some embodiments, the ninth transistor T9 in the light emitting scanning gate-on-array circuit EM_GOA has a greater dimension than the dimension of the ninth transistor T9 in the second control gate-on-array circuit EMS_GOA. Optionally, a ratio of a dimension of the ninth transistor T9 in the light emitting scanning gate-on-array circuit EM_GOA to a dimension of the ninth transistor T9 in the second control gate-on-array circuit EMS_GOA is in a range of 2:1 to 3:1. Optionally, a ratio of a channel length of the ninth transistor T9 in the light emitting scanning gate-on-array circuit EM_GOA to a channel length of the ninth transistor T9 in the second control gate-on-array circuit EMS_GOA is in a range of 2:1 to 3:1. Optionally, a ratio of a channel width of the ninth transistor T9 in the light emitting scanning gate-on-array circuit EM_GOA to a channel width of the ninth transistor T9 in the second control gate-on-array circuit EMS_GOA is in a range of 2:1 to 3:1.

In some embodiments, the tenth transistor T10 in the light emitting scanning gate-on-array circuit EM_GOA has a greater dimension than the dimension of the tenth transistor T10 in the second control gate-on-array circuit EMS_GOA. Optionally, a ratio of a dimension of the tenth transistor T10 in the light emitting scanning gate-on-array circuit EM_GOA to a dimension of the tenth transistor T10 in the second control gate-on-array circuit EMS_GOA is in a range of 2:1 to 3:1. Optionally, a ratio of a channel length of the tenth transistor T10 in the light emitting scanning gate-on-array circuit EM_GOA to a channel length of the tenth transistor T10 in the second control gate-on-array circuit EMS_GOA is in a range of 2:1 to 3:1. Optionally, a ratio of a channel width of the tenth transistor T10 in the light emitting scanning gate-on-array circuit EM_GOA to a channel width of the tenth transistor T10 in the second control gate-on-array circuit EMS_GOA is in a range of 2:1 to 3:1.

Figure 16:
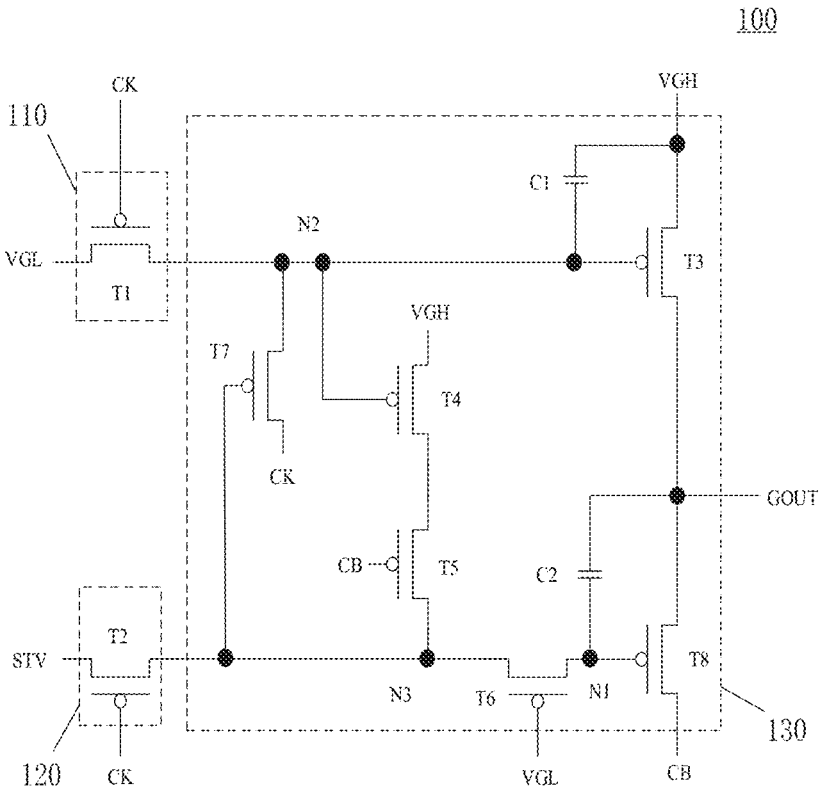
FIG. 16 is a schematic diagram of a circuit structure of a shift register unit of a display substrate provided by some embodiments of the present disclosure.
Figure 17:
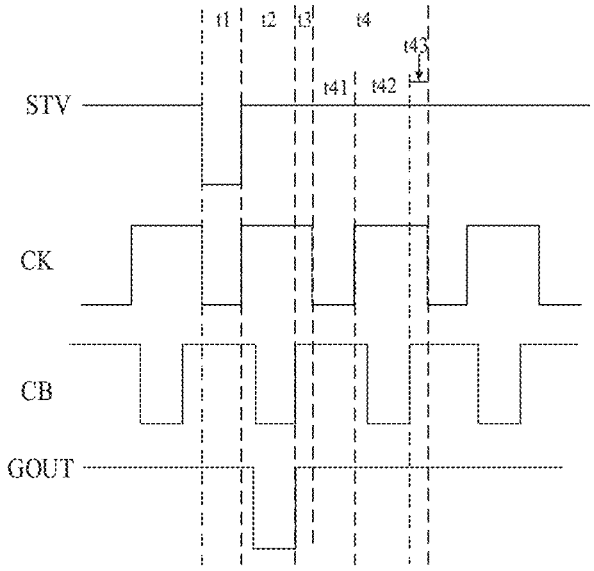
FIG. 17 is a timing diagram of signals in a case where the light-emitting control shift register as shown in FIG. 16 operates.

FIG. 16 is a schematic diagram of a circuit structure of a shift register unit of a display substrate provided by some embodiments of the present disclosure. FIG. 17 is a timing diagram of signals in a case where the shift register as shown in FIG. 16 operates. The shift register as shown in FIG. 16 is representative of a respective shift register in the gate scanning gate-on-array circuit Gate_GOA or a respective shift register in the first control gate-on-array circuit RST_GOA, in some examples of the present disclosure.

For example, as illustrated in FIG. 16, the shift register unit 100 includes an input control circuit 110, an input circuit 120, an output circuit 130, and an output terminal GOUT.

For example, a first signal line group of the display substrate includes a first clock signal line CK and a second clock signal line CB, the first clock signal line CK is configured to provide a first clock signal, and the second clock signal line CB is configured to provide a second clock signal. A plurality of power lines include a first power line VGL and a second power line VGH, the first power line VGL is configured to provide a first power signal, and the second power line VGH is configured to provide a second power signal.

For example, the input control circuit 110 is configured to input the first power signal to the output circuit 130 in response to the first clock signal.

For example, as illustrated in FIG. 16, the input control circuit 110 is electrically connected to the first power line VGL, the first clock signal line CK, and a second node N2, respectively. The first power line VGL is configured to provide the first power signal, the first clock signal line CK is configured to provide the first clock signal, and the second node N2 is electrically connected to the output circuit 130. The input control circuit 110 is configured to write the first power signal on the first power line VGL to the second node N2 under control of the first clock signal on the first clock signal line CK. That is, under control of the first clock signal, where the input control circuit 110 is turned on, the first power signal on the first power line VGL may be transmitted to the output circuit 130.

For example, the input control circuit 110 includes a first transistor T1, and a control terminal of the input control circuit 110 includes a gate electrode of the first transistor T1. The gate electrode of the first transistor T1 is electrically connected to the first clock signal line CK to receive the first clock signal, a first electrode of the first transistor T1 is electrically connected to the first power line VGL to receive the first power signal, and a second electrode of the first transistor T1 is electrically connected to the second node N2.

For example, the input circuit 120 is configured to input an input signal to the output circuit 130 in response to the first clock signal.

For example, as illustrated in FIG. 16, the input circuit 120 is electrically connected to an input signal line STV, the first clock signal line CK, and a third node N3, respectively. The input signal line STV is configured to provide the input signal, the first clock signal line CK is configured to provide the first clock signal, and the third node N3 is electrically connected to the output circuit 130. The input circuit 120 is configured to write the input signal on the input signal line STV to the third node N3 under control of the first clock signal on the first clock signal line CK. That is, under control of the first clock signal, in the case where the input circuit 120 is turned on, the input signal on the input signal line STV may be transmitted to the output circuit 130.

For example, the input circuit 120 includes a second transistor T2, and a control terminal of the input circuit 120 includes a gate electrode of the second transistor T2. The gate electrode of the second transistor T2 is electrically connected to the first clock signal line CK to receive the first clock signal, a first electrode of the second transistor T2 is electrically connected to the input signal line STV to receive the input signal, and a second electrode of the second transistor T2 is electrically connected to the third node N3.

It should be noted that, in the example illustrated in FIG. 16, both the gate electrode of the first transistor T1 and the gate electrode of the second transistor T2 are electrically connected to the first clock signal line CK, but the embodiments of the present disclosure are not limited to this. In some examples, the gate electrode of the first transistor T1 and the gate electrode of the second transistor T2 may also be electrically connected to two different signal lines, respectively.

For example, the output circuit 130 is configured to output the second clock signal or the second power signal to the output terminal GOUT under control of the input signal and the first power signal.

For example, as illustrated in FIG. 16, the output circuit 130 is electrically connected to the second node N2, the third node N3, the output terminal GOUT, the first power line VGL, the second power line VGH, the first clock signal line CK, and the second clock signal line CB, respectively. The first power line VGL is configured to provide the first power signal, the second power line VGH is configured to provide the second power signal, and the second clock signal line CB is configured to provide the second clock signal. The output circuit 130 outputs the second clock signal on the second clock signal line CB or the second power signal on the second power line VGH to the output terminal GOUT under control of the input signal written to the third node N3 and the first power signal written to the second node N2. That is, under control of the input signal and the first power signal, in the case where the output circuit 130 allows the second clock signal line CB to be electrically connected to the output terminal GOUT, the second clock signal may be output to the output terminal GOUT as the output signal. Alternatively, in the case where the output circuit 130 allows the second power line VGH to be electrically connected to the output terminal GOUT, the second power signal may be output to the output terminal GOUT as the output signal.

For example, in the case where the gate driving circuit includes a plurality of cascaded shift register units 100 illustrated in FIG. 16, the output terminals GOUT may be electrically connected to corresponding gate lines, so as to control a plurality of rows of pixel units in the pixel array on the display substrate 10 to be sequentially turned on, that is, the output signal of the output terminal GOUT may be used as a switching-state voltage signal for control ling each pixel unit of the display substrate 10.

For example, the output circuit 130 includes an output sub-circuit, a first output control sub-circuit, and a second output control sub-circuit.

For example, as illustrated in FIG. 16, the output sub-circuit is electrically connected to the second clock signal line CB, the output terminal GOUT, and the first node N1, respectively. The output sub-circuit is configured to output the second clock signal on the second clock signal line CB to the output terminal GOUT as the output signal under control of the level of the first node N1.

For example, the output sub-circuit includes an eighth transistor T8, a gate electrode of the eighth transistor T8 is electrically connected to the first node N1, a first electrode of the eighth transistor T8 is electrically connected to the second clock signal line CB to receive the second clock signal, and a second electrode of the eighth transistor T8 is electrically connected to the output terminal GOUT.

For example, the first output control sub-circuit is electrically connected to the second power line VGH, the output terminal GOUT, and the second node N2, respectively. The first output control sub-circuit is configured to output the second power signal on the second power line VGH to the output terminal GOUT as the output signal under control of the level of the second node N2.

For example, the first output control sub-circuit includes a third transistor T3, a gate electrode of the third transistor T3 is electrically connected to the second node N2, a first electrode of the third transistor T3 is electrically connected to the second power line VGH to receive the second power signal, and a second electrode of the third transistor T3 is electrically connected to the output terminal GOUT.

For example, the second output control sub-circuit is electrically connected to the first node N1, the second node N2, the third node N3, the first clock signal line CK, the second clock signal line CB, the first power line VGL, and the second power line VGH, respectively. The second output control sub-circuit is configured to control the level of the first node N1 and the level of the second node N2. For example, in the case where the level of the first node N1 may control the output sub-circuit to be turned on, the output sub-circuit may write the second clock signal to the output terminal GOUT as the output signal; and in the case where the level of the second node N2 may control the first output control sub-circuit to be turned on, the first output control sub-circuit may write the second power signal to the output terminal GOUT as the output signal.

For example, the second output control sub-circuit includes a fourth transistor T4, a fifth transistor T5, a sixth transistor T6, and a seventh transistor T7.

For example, a gate electrode of the fourth transistor T4 is electrically connected to the second node N2, a first electrode of the fourth transistor T4 is electrically connected to the second power line VGH to receive the second power signal, and a second electrode of the fourth transistor T4 is electrically connected to a first electrode of the fifth transistor T5.

For example, a gate electrode of the fifth transistor T5 is electrically connected to the second clock signal line CB to receive the second clock signal, and a second electrode of the fifth transistor T5 is electrically connected to the third node N3.

For example, a gate electrode of the sixth transistor T6 is electrically connected to the first power line VGL to receive the first power signal, a first electrode of the sixth transistor T6 is electrically connected to the third node N3, and a second electrode of the sixth transistor T6 is electrically connected to the first node N1.

For example, a gate electrode of the seventh transistor T7 is electrically connected to the third node N3, a first electrode of the seventh transistor T7 is electrically connected to the first clock signal line CK to receive the first clock signal, and a second electrode of the seventh transistor T7 is electrically connected to the second node N2.

For example, as illustrated in FIG. 16, the output circuit 130 further includes a first storage sub-circuit, and the first storage sub-circuit is used for maintaining the level at the second node N2. For example, the first storage sub-circuit includes a first capacitor C1, a first electrode of the first capacitor C1 is electrically connected to the second node N2, and a second electrode of the first capacitor C1 is electrically connected to the second power line VGH and the first electrode of the third transistor T3.

For example, as illustrated in FIG. 16, the output circuit 130 further includes a second storage sub-circuit, and the second storage sub-circuit is used for maintaining the level at the first node N1. For example, the second storage sub-circuit includes a second capacitor C2, a first electrode of the second capacitor C2 is electrically connected to the first node N1, and a second electrode of the second capacitor C2 is electrically connected to the output terminal GOUT and the second electrode of the eighth transistor T8.

For example, both the first power signal and the second power signal may be direct-current voltage signals. For example, the first power signal is a low-level signal (for example, 0V, −5V, or other voltages), and the second power signal is a high-level signal (for example, 5V, 10V, or other voltages). It should be noted that the low-level signal and the high-level signal are relative, and the low-level signal is smaller than the high-level signal. In different embodiments, values of the high-level signals may be different, and values of the low-level signals may also be different.

It should be noted that the input control circuit 110, the input circuit 120, and the output circuit 130 illustrated in FIG. 16 are only an example of the embodiments of the present disclosure, and the shift register unit of the display substrate provided by the embodiments of the present disclosure includes but is not limited to the case illustrated in FIG. 16.

It should be noted that all the transistors used in the embodiments of the present disclosure may be thin film transistors, field effect transistors, or other switching components with the same characteristics. The source electrode and drain electrode of the transistor used here may be symmetrical in structure, and therefore, the source electrode and drain electrode of the transistor may have no difference in structure. In the embodiments of the present disclosure, in order to distinguish the two electrodes of the transistor except the gate electrode, one of the two electrodes is described as the first electrode, and another of the two electrodes is described as the second electrode, so that the first electrode and the second electrode of all or part of the transistors in the embodiments of the present disclosure may be interchanged as needed. For example, the first electrode of the transistor described in the embodiments of the present disclosure may be the source electrode, and the second electrode of the transistor described in the embodiments of the present disclosure may be the drain electrode. Alternatively, the first electrode of the transistor may be the drain electrode, and the second electrode of the transistor may be the source electrode. In addition, the transistors may be divided into N-type transistors and P-type transistors according to the characteristics. In the case where the transistor is the P-type transistor, the turn-on voltage is a low-level voltage (for example, 0V, −5V, or other values), and the turn-off voltage is a high-level voltage (for example, 5V, 10V, or other values); and in the case where the transistor is the N-type transistor, the turn-on voltage is a high-level voltage (for example, 5V, 10V, or other values), and the turn-off voltage is a low-level voltage (for example, 0V, −5V, or other values).

For example, in the embodiments of the present disclosure illustrated in FIG. 16, all the transistors are P-type transistors.

For example, in the embodiments of the present disclosure illustrated in FIG. 16, the channel of the transistor may correspond to, for example, the channel region between the source region and the drain region of the active layer of the transistor, the distance between the source region and the drain region is the length of the channel of the transistor, and the extending direction of the channel of the transistor is the direction from the first electrode to the second electrode of the transistor. The extending direction of the channel of at least one selected form a group consisting of the first transistor T1 to the eighth transistor 8 is parallel to the extending direction of the clock signal line (for example, the first clock signal line CK and the second clock signal line CB), so that the width of the position occupied by the gate driving circuit including a plurality of cascaded shift register units in the display substrate is reduced, thereby optimizing the layout structure of the display substrate and reducing the frame size of the display device including the display substrate to achieve the narrow frame design.

As discussed above, the shift register as shown in FIG. 16 is representative of a respective shift register in the gate scanning gate-on-array circuit Gate_GOA or a respective shift register in the first control gate-on-array circuit RST_GOA, in some examples of the present disclosure. In some embodiments, the third transistor T3 in the gate scanning gate-on-array circuit Gate_GOA has a greater dimension than the dimension of the third transistor T3 in the first control gate-on-array circuit RST_GOA. Optionally, a ratio of a dimension of the third transistor T3 in the gate scanning gate-on-array circuit Gate_GOA to a dimension of the third transistor T3 in the first control gate-on-array circuit RST_GOA is in a range of 2:1 to 3:1. Optionally, a ratio of a channel length of the third transistor T3 in the gate scanning gate-on-array circuit Gate_GOA to a channel length of the third transistor T3 in the first control gate-on-array circuit RST_GOA is in a range of 2:1 to 3:1. Optionally, a ratio of a channel width of the third transistor T3 in the gate scanning gate-on-array circuit Gate_GOA to a channel width of the third transistor T3 in the first control gate-on-array circuit RST_GOA is in a range of 2:1 to 3:1.

Optionally, a ratio of a dimension of the eighth transistor T8 in the gate scanning gate-on-array circuit Gate_GOA to a dimension of the eighth transistor T8 in the first control gate-on-array circuit RST_GOA is in a range of 2:1 to 3:1. Optionally, a ratio of a channel length of the eighth transistor T8 in the gate scanning gate-on-array circuit Gate_GOA to a channel length of the eighth transistor T8 in the first control gate-on-array circuit RST_GOA is in a range of 2:1 to 3:1. Optionally, a ratio of a channel width of the eighth transistor T8 in the gate scanning gate-on-array circuit Gate_GOA to a channel width of the eighth transistor T8 in the first control gate-on-array circuit RST_GOA is in a range of 2:1 to 3:1.

In some embodiments, the display apparatus further includes a data driving integrated circuit. Optionally, the data driving integrated circuit is configured to, prior to displaying a respective frame of image of a plurality of frames of images, provide data voltage signals to a plurality of subpixels in the respective frame of image; and assign a calculated value as a value of the voltage maintaining signal. Optionally, the calculated value is calculated by a function based on the data voltage signals of the plurality of subpixels in the respective frame of image. Optionally, the function includes an averaging algorithm, and the calculated value equals to a sum of the threshold voltage of the driving transistor and an average value of the data voltage signals of the plurality of subpixels. Optionally, the averaging algorithm is selected from a group consisting of root mean square value algorithm, arithmetic mean algorithm, geometric mean algorithm, and weighted mean algorithm. Optionally, the function is based on a data signal compensation model f(Vdata(1), Vdata(2), . . . , Vdata(N)); and Vdata(1), Vdata(2), . . . , Vdata(N) stand for the data voltage signals of the plurality of subpixels.

In another aspect, the present disclosure provides an array substrate. Referring to FIG. 11 to FIG. 17, the array substrate in some embodiments includes a first control gate-on-array circuit RST_GOA including a plurality of first cascaded shift registers; a second control gate-on-array circuit EMS_GOA including a plurality of second cascaded shift registers; and multiple rows of dual signal switch sub-circuit and inverse switch sub-circuit, a respective row comprising a dual signal switch sub-circuit SCdss and an inverse switch sub-circuit SCis.

In some embodiments, the dual signal switch sub-circuit SCdss in the respective row is connected to a first reset signal line SLr1; and the inverse switch sub-circuit SCis in the respective row is connected to the dual signal switch sub-circuit SCdss. Optionally, the dual signal switch sub-circuit SCdss is configured to generate a first initialization voltage signal Vint1 in a reset phase, and generate a voltage maintaining signal Vvm in a voltage maintaining phase. Optionally, in the reset phase, the inverse switch sub-circuit SCis is configured to generate a first turning-off control signal through a first control signal line SLc1 to a gate electrode of a first control transistor Tc1 to turn off the first control transistor Tc1 of the dual signal switch sub-circuit SCdss, and generate a second turning-on control signal Von2 through a second control signal line SLc2 to a gate electrode of a second control transistor Tc2 to turn on the second control transistor Tc2 of the dual signal switch sub-circuit SCdss. Optionally, in the voltage maintaining phase, the inverse switch sub-circuit SCis is configured to generate a first turning-on control signal Von1 through the first control signal line SLc1 to the gate electrode of the first control transistor Tc1 to turn on the first control transistor Tc1 of the dual signal switch sub-circuit SCdss, and generate a second turning-off control signal Voff2 through a second control signal line SLc2 to a gate electrode of the second control transistor Tc2 to turn off the second control transistor Tc2 of the dual signal switch sub-circuit SCdss.

In some embodiments, the multiple rows of dual signal switch sub-circuit and inverse switch sub-circuit are respectively connected to multiple first shift registers of the first control gate-on-array circuit RST_GOA. Optionally, a number of the multiple rows is same as a number of the multiple first shift registers. Optionally, a respective first shift register in the multiple first shift registers configured to provide the third turning-off control signal Voff3 and the third turning-on control signal Von3 to an inverse switch sub-circuit SCis in a respective row of the multiple rows.

In some embodiments, the multiple rows of dual signal switch sub-circuit and inverse switch sub-circuit are commonly connected to a single second shift register of the second control gate-on-array circuit EMS_GOA. Optionally, the single second shift register is configured to provide the first turning-on control signal Von1 and the first turning-off control signal Voff1 to inverse switch sub-circuits and dual signal switch sub-circuits in the multiple rows of dual signal switch sub-circuit and inverse switch sub-circuit.

In some embodiments, the array substrate further includes a gate scanning gate-on-array circuit Gate_GOA including a plurality of third cascaded shift registers configured to generate a plurality of gate driving signals; and a light emitting scanning gate-on-array circuit EM_GOA including a plurality of fourth cascaded shift registers configured to generate a plurality of light emitting control signals. Optionally, a respective one of the plurality of first cascaded shift registers and a respective one of the plurality of third cascaded shift registers have a same circuit structure. Optionally, a respective one of the plurality of second cascaded shift registers and a respective one of the plurality of fourth cascaded shift registers have a same circuit structure. Optionally, a ratio of dimensions of output transistors respectively in the respective one of the plurality of first cascaded shift registers and the respective one of the plurality of third cascaded shift registers is in a range of 1:3 to 1:2. Optionally, a ratio of dimensions of output transistors respectively in the respective one of the plurality of second cascaded shift registers and the respective one of the plurality of fourth cascaded shift registers is in a range of 1:3 to 1:2.

In some embodiments, the array substrate further includes multiple rows of pixel driving circuits respectively electrically connected to the multiple rows of dual signal switch sub-circuit and inverse switch sub-circuit. Optionally, the multiple rows of pixel driving circuits are in a display area AA of the array substrate. Optionally, the first control gate-on-array circuit RST_GOA, the second control gate-on-array circuit EMS_GOA, the gate scanning gate-on-array circuit Gate_GOA, the light emitting scanning gate-on-array circuit EM_GOA, and the multiple rows of dual signal switch sub-circuit and inverse switch sub-circuit are in a peripheral area of the array substrate. Optionally, the light emitting scanning gate-on-array circuit EM_GOA is on a side of the gate scanning gate-on-array circuit Gate_GOA away from the display area AA. Optionally, a column of dual signal switch sub-circuits respectively from the multiple rows of dual signal switch sub-circuit and inverse switch sub-circuit is on a side of the light emitting scanning gate-on-array circuit EM_GOA away from the gate scanning gate-on-array circuit Gate_GOA. Optionally, a column of inverse switch sub-circuits respectively from the multiple rows of dual signal switch sub-circuit and inverse switch sub-circuit is on a side of the column of dual signal switch sub-circuits away from the light emitting scanning gate-on-array circuit EM_GOA. Optionally, the first control gate-on-array circuit RST_GOA is on a side of the column of inverse switch sub-circuits away from the column of dual signal switch sub-circuits. Optionally, the second control gate-on-array circuit EMS_GOA is on a side of the first control gate-on-array circuit RST_GOA away from the column of inverse switch sub-circuits.

As used herein, the term "display area" refers to an area of an array substrate in a display panel where image is actually displayed. Optionally, the display area may include both a subpixel region and an inter-subpixel region. A subpixel region refers to a light emission region of a subpixel, such as a region corresponding to a pixel electrode in a liquid crystal display or a region corresponding to a light emissive layer in an organic light emitting diode display panel. An inter-subpixel region refers to a region between adjacent subpixel regions, such as a region corresponding to a black matrix in a liquid crystal display or a region corresponding a pixel definition layer in an organic light emitting diode display panel. Optionally, the inter-subpixel region is a region between adjacent subpixel regions in a same pixel. Optionally, the inter-subpixel region is a region between two adjacent subpixel regions from two adjacent pixels. As used herein the term "peripheral area" refers to an area of an array substrate in a display panel where various circuits and wires are provided to transmit signals to the display substrate. To increase the transparency of the display apparatus, non-transparent or opaque components of the display apparatus (e.g., battery, printed circuit board, metal frame), can be disposed in the peripheral area rather than in the display areas.

In another aspect, the present disclosure provides a pixel driving method. In some embodiments, the pixel driving method includes, in a reset phase, turning on a first reset transistor to allow a first initialization voltage signal to be written into a second capacitor electrode of a storage capacitor; in a data write phase, turning on a data write sub-circuit to allow a voltage of a data voltage signal and a threshold voltage of a driving transistor to be written into the second capacitor electrode; in a voltage maintaining phase, turning off the first reset transistor and providing a voltage maintaining signal from a first reset signal line to the source electrode of the first reset transistor; and, in a light emitting phase, turning on the light emitting control sub-circuit to control a voltage supply signal of the voltage supply line to be written into the driving transistor, and the driving transistor generate a driving current for driving a light emitting element to emit light when a voltage of the second capacitor electrode is greater than a threshold voltage of the driving transistor. The voltage maintaining signal is different from the first initialization voltage signal. Optionally, the pixel driving method further includes providing a turning-off reset control signal through a reset control signal line to a gate electrode of the first reset transistor to turn off the first reset transistor in at least one of an initial phase, the data write phase, the voltage maintaining phase, and the light emitting phase. Optionally, the pixel driving method further includes, in the reset phase, providing a turning-on reset control signal through a reset control signal line to a gate electrode of the first reset transistor to allow the first initialization voltage signal from the first reset signal line to be written into the second capacitor electrode of the storage capacitor.

In some embodiments, the pixel driving method further includes, in the reset phase, turning on the second reset transistor to allow a second initialization voltage signal into the anode of the light emitting element in the reset phase. The voltage maintaining signal is different from the second initialization voltage signal.

In some embodiments, the pixel driving method further includes generating, using a dual signal switch sub-circuit connected to the first reset signal line, the first initialization voltage signal in the reset phase, and the voltage maintaining signal in the voltage maintaining phase.

In some embodiments, generating the first initialization voltage signal in the reset phase includes providing a first turning-off control signal through a first control signal line to a gate electrode of a first control transistor to turn off the first control transistor of the dual signal switch sub-circuit; providing the first initialization voltage signal through a second switch signal line to a source electrode of a second control transistor; and providing a second turning-on control signal through a second control signal line to a gate electrode of the second control transistor to turn on the second control transistor of the dual signal switch sub-circuit, thereby allowing the first initialization voltage signal to pass from the source electrode of the second control transistor to a drain electrode of the second control transistor, and in turn to the first reset signal line connected to the drain electrode of the second control transistor.

In some embodiments, the pixel driving method further includes, in the reset phase, providing the first turning-off control signal through the first control signal line to a gate electrode of a third control transistor of an inverse switch sub-circuit to turn off the third control transistor of the inverse switch sub-circuit connected to the dual signal switch sub-circuit, and simultaneously to the gate electrode of the first control transistor to turn off the first control transistor; providing a second voltage signal through a second voltage signal line to a source electrode of a fourth control transistor of the inverse switch sub-circuit; and providing a third turning-on control signal through a third control signal line to a gate electrode of the fourth control transistor of the inverse switch sub-circuit to turn on the fourth control transistor of the inverse switch sub-circuit, thereby allowing the second voltage signal to pass from the source electrode of the fourth control transistor to a drain electrode of the fourth control transistor, and in turn to the second control signal line connected to the gate electrode of the second control transistor, the second voltage signal functioning as the second turning-on control signal to turn on the second control transistor in the reset phase.

In some embodiments, generating the voltage maintaining signal in the voltage maintaining phase includes providing the voltage maintaining signal through a first switch signal line to a source electrode of a first control transistor; providing a first turning-on control signal through the first control signal line to the gate electrode of the first control transistor to turn on the first control transistor of the dual signal switch sub-circuit, thereby allowing the voltage maintaining signal to pass from the source electrode of the first control transistor to a drain electrode of the first control transistor, and in turn to the first reset signal line connected to the drain electrode of the first control transistor; and providing a second turning-off control signal through a second control signal line to a gate electrode of a second control transistor to turn off the second control transistor of the dual signal switch sub-circuit.

In some embodiments, the pixel driving method further includes, in the voltage maintaining phase, providing a first voltage signal through a first voltage signal line to a source electrode of a third control transistor of an inverse switch sub-circuit connected to the dual signal switch sub-circuit; providing the first turning-on control signal through the first control signal line to a gate electrode of the third control transistor to turn on the third control transistor, thereby allowing the first voltage signal to pass from the source electrode of the third control transistor to a drain electrode of the third control transistor, and in turn to the second control signal line connected to the gate electrode of the second control transistor, the first voltage signal functioning as the second turning-off control signal to turn off the second control transistor in in the voltage maintaining phase; and providing a third turning-off control signal through a third control signal line to a gate electrode of a fourth control transistor of the inverse switch sub-circuit to turn off the fourth control transistor.

In some embodiments, the pixel driving method further includes generating, using the dual signal switch sub-circuit connected to the first reset signal line, the first initialization voltage signal in the data write phase.

In some embodiments, the pixel driving method further includes generating, using the dual signal switch sub-circuit connected to the first reset signal line, the first initialization voltage signal in an initial phase.

In some embodiments, the pixel driving method further includes, prior to displaying a respective frame of image of a plurality of frames of images, obtaining data voltage signals of a plurality of subpixels of a display panel in the respective frame of image; and assigning a calculated value as a value of the voltage maintaining signal. Optionally, the calculated value is calculated by a function based on the data voltage signals of the plurality of subpixels in the respective frame of image. Optionally, the function includes an averaging algorithm. Optionally, the calculated value equals to a sum of the threshold voltage of the driving transistor and an average value of the data voltage signals of the plurality of subpixels. As used herein, the term "average" includes all known calculation methods that lead to an average value thereby formed. Examples of averaging algorithms include, but are not limited to, root mean square value algorithm, arithmetic mean algorithm, geometric mean algorithm, and weighted mean algorithm. Optionally, the averaging algorithm is selected from a group consisting of root mean square value algorithm, arithmetic mean algorithm, geometric mean algorithm, and weighted mean algorithm. Optionally, the function is based on a data signal compensation model f(Vdata(1), Vdata(2), . . . , Vdata(N)); wherein Vdata(1), Vdata(2), . . . , Vdata(N) stand for the data voltage signals of the plurality of subpixels.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An array substrate, comprising:

a first control gate-on-array circuit comprising a plurality of first cascaded shift registers;

a second control gate-on-array circuit comprising a plurality of second cascaded shift registers; and multiple rows of dual signal switch sub-circuit and inverse switch sub-circuit, a respective row comprising a dual signal switch sub-circuit and an inverse switch sub-circuit;

wherein the dual signal switch sub-circuit in the respective row is connected to a first reset signal line; and the inverse switch sub-circuit in the respective row is connected to the dual signal switch sub-circuit;

the dual signal switch sub-circuit is configured to generate a first initialization voltage signal in a reset phase, and generate a voltage maintaining signal in a voltage maintaining phase;

in the reset phase, the inverse switch sub-circuit is configured to generate a first turning-off control signal through a first control signal line to a gate electrode of a first control transistor of the dual signal switch sub-circuit to turn off the first control transistor, and generate a second turning-on control signal through a second control signal line to a gate electrode of a second control transistor of the dual signal switch sub-circuit to turn on the second control transistor; and in the voltage maintaining phase, the inverse switch sub-circuit is configured to generate a first turning-on control signal through the first control signal line to the gate electrode of the first control transistor of the dual signal switch sub-circuit to turn on the first control transistor, and generate a second turning-off control signal through a second control signal line to a gate electrode of the second control transistor of the dual signal switch sub-circuit to turn off the second control transistor;

wherein the multiple rows of dual signal switch sub-circuit and inverse switch sub-circuit are respectively connected to multiple first shift registers of the first control gate-on-array circuit, a row number of the multiple rows is same as a number of the multiple first shift registers, a respective first shift register in the multiple first shift registers configured to provide a third turning-off control signal and a third turning-on control signal to an inverse switch sub-circuit in a respective row of the multiple rows; and the multiple rows of dual signal switch sub-circuit and inverse switch sub-circuit are commonly connected to a single second shift register of the second control gate-on-array circuit, the single second shift register configured to provide the first turning-on control signal and the first turning-off control signal to inverse switch sub-circuits and dual signal switch sub-circuits in the multiple rows of dual signal switch sub-circuit and inverse switch sub-circuit.

2. The array substrate of claim 1, further comprising:

a gate scanning gate-on-array circuit comprising a plurality of third cascaded shift registers configured to generate a plurality of gate driving signals; and a light emitting scanning gate-on-array circuit comprising a plurality of fourth cascaded shift registers configured to generate a plurality of light emitting control signals;

wherein a respective one of the plurality of first cascaded shift registers and a respective one of the plurality of third cascaded shift registers have a same circuit structure;

a respective one of the plurality of second cascaded shift registers and a respective one of the plurality of fourth cascaded shift registers have a same circuit structure;

a ratio of dimensions of output transistors respectively in the respective one of the plurality of first cascaded shift registers and the respective one of the plurality of third cascaded shift registers is in a range of 1:3 to 1:2; and a ratio of dimensions of output transistors respectively in the respective one of the plurality of second cascaded shift registers and the respective one of the plurality of fourth cascaded shift registers is in a range of 1:3 to 1:2.

3. The array substrate of claim 2, further comprising multiple rows of pixel driving circuits respectively electrically connected to the multiple rows of dual signal switch sub-circuit and inverse switch sub-circuit;

wherein the multiple rows of pixel driving circuits are in a display area of the array substrate;

the first control gate-on-array circuit, the second control gate-on-array circuit, the gate scanning gate-on-array circuit, the light emitting scanning gate-on-array circuit, and the multiple rows of dual signal switch sub-circuit and inverse switch sub-circuit are in a peripheral area of the array substrate;

the light emitting scanning gate-on-array circuit is on a side of the gate scanning gate-on-array circuit away from the display area;

a column of dual signal switch sub-circuits respectively from the multiple rows of dual signal switch sub-circuit and inverse switch sub-circuit is on a side of the light emitting scanning gate-on-array circuit away from the gate scanning gate-on-array circuit;

a column of inverse switch sub-circuits respectively from the multiple rows of dual signal switch sub-circuit and inverse switch sub-circuit is on a side of the column of dual signal switch sub-circuits away from the light emitting scanning gate-on-array circuit;

the first control gate-on-array circuit is on a side of the column of inverse switch sub-circuits away from the column of dual signal switch sub-circuits; and the second control gate-on-array circuit is on a side of the first control gate-on-array circuit away from the column of inverse switch sub-circuits.

4. A display apparatus, comprising a pixel driving circuit, a first control gate-on-array circuit, a second control gate-on-array circuit, a dual signal switch sub-circuit, an inverse switch sub-circuit;

wherein the pixel driving circuit comprises:

a storage capacitor comprising a first capacitor electrode and a second capacitor electrode, the first capacitor electrode connected to a voltage supply line;

a driving transistor configured to generate a driving current for driving a light emitting element to emit light when a voltage of the second capacitor electrode is greater than a threshold voltage of the driving transistor, a gate electrode of the driving transistor is connected to the second capacitor electrode;

a data write sub-circuit connected to a data line and connected to the second capacitor electrode, the data write sub-circuit configured to write a voltage of a data voltage signal and a threshold voltage of the driving transistor into the second capacitor electrode in a data write phase;

a light emitting control sub-circuit connected to the driving transistor, the light emitting control sub-circuit configured to control a voltage supply signal of the voltage supply line to be written into the driving transistor to generate a driving signal in a light emitting phase; and a first reset transistor having a gate electrode connected to a reset control signal line, a source electrode connected to a first reset signal line, and a drain electrode connected to the gate electrode of the driving transistor and the second capacitor electrode;

wherein the first reset transistor is configured to be turned on to allow a first initialization voltage signal provided by the first reset signal line to be written into the second capacitor electrode in a reset phase;

the first reset transistor is configured to be turned off and the first reset signal line is configured to provide a voltage maintaining signal to the source electrode of the first reset transistor in a voltage maintaining phase;

the voltage maintaining signal is different from the first initialization voltage signal;

the first control gate-on-array circuit is connected to the third control signal line, the second control gate-on-array circuit is connected to the first control signal line, the dual signal switch sub-circuit is connected to the first reset signal line, the inverse switch sub-circuit is connected to the dual signal switch sub-circuit; and the dual signal switch sub-circuit is configured to generate the first initialization voltage signal in the reset phase, and generate the voltage maintaining signal in the voltage maintaining phase;

wherein the dual signal switch sub-circuit comprises:

a first control transistor having a gate electrode connected to a first control signal line, a source electrode connected to a first switch signal line configured to provide the voltage maintaining signal, and a drain electrode connected to the first reset signal line; and a second control transistor having a gate electrode connected to a second control signal line, a source electrode connected to a second switch signal line configured to provide the first initialization voltage signal, and a drain electrode connected to the first reset signal line;

wherein, in the reset phase and the data write phase, the first control transistor is configured to be turned off, and the second control transistor is configured to be turned on; and in the voltage maintaining phase, the first control transistor is configured to be turned on, and the second control transistor is configured to be turned off;

wherein, in the reset phase, the inverse switch sub-circuit is configured to generate a first turning-off control signal through a first control signal line to a gate electrode of a first control transistor of the dual signal switch sub-circuit to turn off the first control transistor, and generate a second turning-on control signal through a second control signal line to a gate electrode of a second control transistor of the dual signal switch sub-circuit to turn on the second control transistor; and in the voltage maintaining phase, the inverse switch sub-circuit is configured to generate a first turning-on control signal through the first control signal line to the gate electrode of the first control transistor of the dual signal switch sub-circuit to turn on the first control transistor, and generate a second turning-off control signal through a second control signal line to a gate electrode of the second control transistor of the dual signal switch sub-circuit to turn off the second control transistor;

wherein the inverse switch sub-circuit comprises:

a third control transistor having a gate electrode connected to the first control signal line, a source electrode connected to a first voltage signal line configured to provide a first voltage signal, and a drain electrode connected to the second control signal line; and a fourth control transistor having a gate electrode connected to a third control signal line, a source electrode connected to a second voltage signal line configured to provide a second voltage signal, and a drain electrode connected to the second control signal line;

wherein, in the reset phase and the data write phase, the third control transistor is configured to be turned off, and the fourth control transistor is configured to be turned on; and in the voltage maintaining phase, the third control transistor is configured to be turned on, and the fourth control transistor is configured to be turned off;

wherein the display apparatus comprises a plurality of rows of pixel driving circuits;

the pixel driving circuit is in a respective row of the plurality of rows of pixel driving circuits;

the respective row of the plurality of rows of pixel driving circuits is connected to the dual signal switch sub-circuit and the inverse switch sub-circuit; and the dual signal switch sub-circuit is configured to generate the first initialization voltage signal in the reset phase, and generate the voltage maintaining signal in the voltage maintaining phase, for the respective row of the plurality of rows of pixel driving circuits.

5. The display apparatus of claim 4, further comprising a data driving integrated circuit;

wherein the data driving integrated circuit is configured to:

prior to displaying a respective frame of image of a plurality of frames of images, provide data voltage signals to a plurality of subpixels in the respective frame of image; and assign a calculated value as a value of the voltage maintaining signal;

wherein the calculated value is calculated by a function based on the data voltage signals of the plurality of subpixels in the respective frame of image.

6. The display apparatus of claim 5, wherein the function comprises an averaging algorithm; and the calculated value equals to a sum of the threshold voltage of the driving transistor and an average value of the data voltage signals of the plurality of subpixels.

7. The display apparatus of claim 6, wherein the averaging algorithm is selected from a group consisting of root mean square value algorithm, arithmetic mean algorithm, geometric mean algorithm, and weighted mean algorithm.

8. The display apparatus of claim 7, wherein the function is based on a data signal compensation model f(Vdata(1), Vdata(2), . . . , Vdata(N)); and Vdata(1), Vdata(2), . . . , Vdata(N) stand for the data voltage signals of the plurality of subpixels.

9. The display apparatus of claim 4, wherein the pixel driving circuit further comprises a second reset transistor having a gate electrode connected to the reset control signal line, a source electrode connected to a second reset signal line, and a drain electrode connected to the light emitting control sub-circuit and an anode of the light emitting element, the second reset transistor configured to write a second initialization voltage signal into the anode of the light emitting element in the reset phase;

wherein the first reset signal line and the second reset signal line are independent of each other; and the voltage maintaining signal is different from the second initialization voltage signal.

10. The display apparatus of claim 4, wherein the data write sub-circuit includes a first transistor and a second transistor;

the first transistor comprises a gate electrode connected to a gate line, a source electrode connected to the data line, and a drain electrode connected to a source electrode of the driving transistor; and the second transistor comprises a gate electrode connected to a gate line, a source electrode connected to the second capacitor electrode of the storage capacitor and the gate electrode of the driving transistor, and a drain electrode connected to a drain electrode of the driving transistor.

11. The display apparatus of claim 4, wherein the light emitting control sub-circuit comprises a third transistor and a fourth transistor;

the third transistor comprises a gate electrode connected to a light emitting control signal line, a source electrode connected to the voltage supply line, and a drain electrode connected to the source electrode of the driving transistor and the drain electrode of the first transistor; and the fourth transistor comprises a gate electrode connected to the light emitting control signal line, a source electrode connected to drain electrodes of the driving transistor and the second transistor, and a drain electrode connected to an anode of a light emitting element.

* * * * *